US007370944B2

(12) United States Patent
Cabal et al.

(10) Patent No.: US 7,370,944 B2
(45) Date of Patent: May 13, 2008

(54) LIQUID EJECTOR HAVING INTERNAL FILTERS

(75) Inventors: Antonio Cabal, Webster, NY (US); Thomas M. Stephany, Churchville, NY (US); Roger G. Markham, Webster, NY (US); John A. Lebens, Rush, NY (US); William R. Zimmerli, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 249 days.

(21) Appl. No.: 10/929,816

(22) Filed: Aug. 30, 2004

(65) Prior Publication Data

US 2006/0044373 A1 Mar. 2, 2006

(51) Int. Cl.
*B41J 2/04* (2006.01)
*B41J 2/05* (2006.01)

(52) U.S. Cl. ..... 347/65; 347/54

(58) Field of Classification Search ..... 347/44, 347/47, 54, 56, 63, 65, 93
See application file for complete search history.

(56) References Cited

U.S. PATENT DOCUMENTS 4,894,664 A * 1/1990 Tsung Pan ..... 347/63
5,734,399 A 3/1998 Weber et al.
6,132,033 A 10/2000 Browning et al.
6,137,510 A 10/2000 Sato et al.
6,158,843 A 12/2000 Murthy et al.
6,247,798 B1 6/2001 Cleland et al.
6,283,584 B1 * 9/2001 Powers et al. ..... 347/65
6,309,054 B1 * 10/2001 Kawamura et al. ..... 347/65
6,478,410 B1 11/2002 Prasad et al.
6,489,084 B1 12/2002 Pidwerbecki et al.
6,502,927 B2 1/2003 Nozawa
6,540,335 B2 4/2003 Touge et al.
6,561,631 B2 5/2003 Shin et al.
6,582,064 B2 6/2003 Cruz-Uribe et al.
6,601,945 B2 8/2003 Kitakami
6,960,424 B2 * 11/2005 Miyagawa et al. ..... 430/320
7,048,358 B2 * 5/2006 Kubota et al. ..... 347/56

FOREIGN PATENT DOCUMENTS

EP 1 380 422 1/2004
JP 06 312506 11/1994

* cited by examiner

*Primary Examiner*—Anh T. N. Vo
(74) *Attorney, Agent, or Firm*—William R. Zimmerli

(57) ABSTRACT

A liquid drop ejector is provided. The ejector includes a liquid chamber and a liquid supply. Portions of the liquid chamber define a nozzle bore. A liquid supply passageway is positioned between the liquid chamber and the liquid supply. The liquid supply passageway is in fluid communication with the liquid chamber and the liquid supply. A plurality of pillars is suspended in the liquid supply passageway. A wall of the liquid chamber can extend to the liquid supply passageway. A center pillar can also be included with a portion of the center pillar being positioned in the liquid chamber and another portion of the center pillar being positioned in the liquid supply passageway.

35 Claims, 32 Drawing Sheets

LIQUID EJECTOR HAVING INTERNAL FILTERS

FIELD OF THE INVENTION

The present invention relates generally to liquid ejectors and, more specifically, to liquid ejectors having internal filters.

BACKGROUND OF THE INVENTION

Inkjet printing systems are extensively used throughout the world for the reproduction and generation of text and images. Inkjet printing systems eject liquids in the form of droplets that are deposited upon a suitable receiver in an image-wise fashion. Common uses include the printing of text and the reproduction of images. Liquids that are ejected can be inks or pigments and the applications vary widely but include printers, plotters, facsimile machines and copiers. For purposes of convenience the concepts of this invention are discussed in the terms of a thermal inkjet printer that employ one or more supplies or reservoirs of liquids to be deposited upon a medium such as paper.

Ink is supplied to a liquid ejector mechanism, also known as a print head, through a supply channel and into a chamber of the liquid ejector that contains thermal resistors as firing mechanisms. Sending an electrical current through the thermal resistors causes the heating of the resistor and forces the formation of a vapor bubble within the chamber. The expanding vapor bubble within the chamber then causes an ink droplet to be forced out of an orifice situated upon the chamber. As ink is expelled from the orifice, energy is removed from the thermal resistor, the bubble collapses and ink refills the chamber to begin another sequence.

As the need for ejection speed increases, so does the optimization of the operation of the chambers to maximize ink flow. Additionally the throughput requirement also means the need for more chambers and ejection orifices. It is a constant engineering challenge to maintain the proper balance that is required to enhance inkjet system performance.

In typical inkjet printing systems, a filter element is generally placed at the inlet to the supply port of an inkjet chamber. Reference U.S. Pat. No. 6,582,064 by Cruz-Uribe et al., of Hewlett-Packard Company, Houston Tex., that describes integrated fluid filters constructed from stacks of stacked thin film layers with openings that function as filters. Reference also U.S. Pat. No. 6,502,927 by Nozawa of Canon Kabushiki Kaisha of Tokyo, Japan that describes pillars as filters. These filters have several functions such as that of an ink conduit and function to preclude the delivery of impurities, debris and air bubbles that could enter the chamber of a liquid ejector and cause clogging of the chamber or orifice thus rendering a firing chamber inoperable.

Chambers and geometries are commonly configured to enhance operational performance. Reference U.S. Pat. No. 6,478,410 by Prasad, et al. of Hewlett-Packard Company, Palo Alto, Calif. that attempts to balance a higher inkjet droplet generator density with structures that attempt to achieve proper control of ink flow. Reference also U.S. Pat. No. 6,601,945 by Kitakami of Canon Kabushiki Kaisha, of Tokyo, Japan that attempts to correct for image quality by using a "windshield liquid droplet" that prevents the displacement upon a recording medium of the ink droplet discharged in a high density "full discharge" mode even when the ink droplet has a fine volume.

U.S. Pat. No. 5,734,399 by Weber et al. of Hewlett-Packard Company of Palo Alto Calif. discloses shaped barrier geometries that prevent stray particles from reaching ink feed channels. The barriers are configured to have a plurality of inner barrier islands each associated with a chamber and a particular heater resistor. These barrier islands commonly occupy a common area between the ink firing chamber and the ink plenum, commonly known as an ink supply.

U.S. Pat. No. 6,540,335 by Touge et al. of Canon Kabushiki Kaisha of Tokyo, Japan discloses an ink jet printhead for preventing problems that are caused by air bubbles caught in the printhead. Bubbles are left in the printhead after liquid discharge, and the invention enables the ejection of droplets with high reliability by controlling the residual bubble.

U.S. Pat. No. 6,137,510 by Sato et al. of Canon Kabushiki Kaisha of Tokyo, Japan discloses the additions of pluralities of ribs that provide increased mechanical strength to the orifice plate and additionally reduce the detrimental effects of air bubbles. These ribs reduce the effects of these retained bubbles thereby achieving reliable ink droplet discharge.

Lastly, U.S. Pat. No. 6,158,843 by Murthy et al. of Lexmark International of Lexington, Ky., discloses pillars extending vertically into the firing chamber but not into the common area.

Filter elements also play an important role in the hydraulic interactions between neighboring nozzles. As the inkjet recording process has matured over the years, so too has the demand for ink jet recording heads to achieve higher recording speeds. Pluralities of nozzles that reside adjacent one another within a given printing system have to be addressed in relationship to one another within a short period of time. As these blocks of nozzles are fired, the stability within adjacent unfired or recently fired nozzles is negatively affected, thereby substantially increasing the interaction between adjacent nozzles. The generation of this adverse hydraulics, coupled with the internal filtering elements, affects the chamber refill time and limits how quickly a particular chamber can be ready to be reused. Since the chamber refill time is directly proportional to how quickly a chamber can be fired, the matching of filter properties is important. Properties that improve the refill efficiencies and additionally satisfy the need to filter impurities such as dust is critical, and most prior art suggests that attempts at doing both well have not been entirely successful.

SUMMARY OF THE INVENTION

According to one feature of the present invention, a liquid drop ejector includes a liquid chamber and a liquid supply. Portions of the liquid chamber define a nozzle bore. A liquid supply passageway is positioned between the liquid chamber and the liquid supply and is in fluid communication with the liquid chamber and the liquid supply. A plurality of pillars is suspended in the liquid supply passageway.

According to another feature of the present invention, a liquid drop ejector includes a plurality of liquid chambers with portions of each of the plurality of liquid chambers defining a nozzle bore. Other portions of each of the plurality of liquid chambers define a wall having a length located between adjacent liquid chambers. A liquid supply passageway is in fluid communication with each of the plurality of liquid chambers. The length of the wall extends into the liquid supply passageway.

According to another feature of the present invention, a liquid drop ejector includes a liquid chamber, a liquid supply, and a center pillar. Portions of the liquid chamber define a nozzle bore. A liquid supply passageway is positioned between the liquid chamber and the liquid supply and is in fluid communication with the liquid chamber and the liquid supply. A portion of the center pillar is positioned in the liquid chamber and another portion of the center pillar is positioned in the liquid supply passageway.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
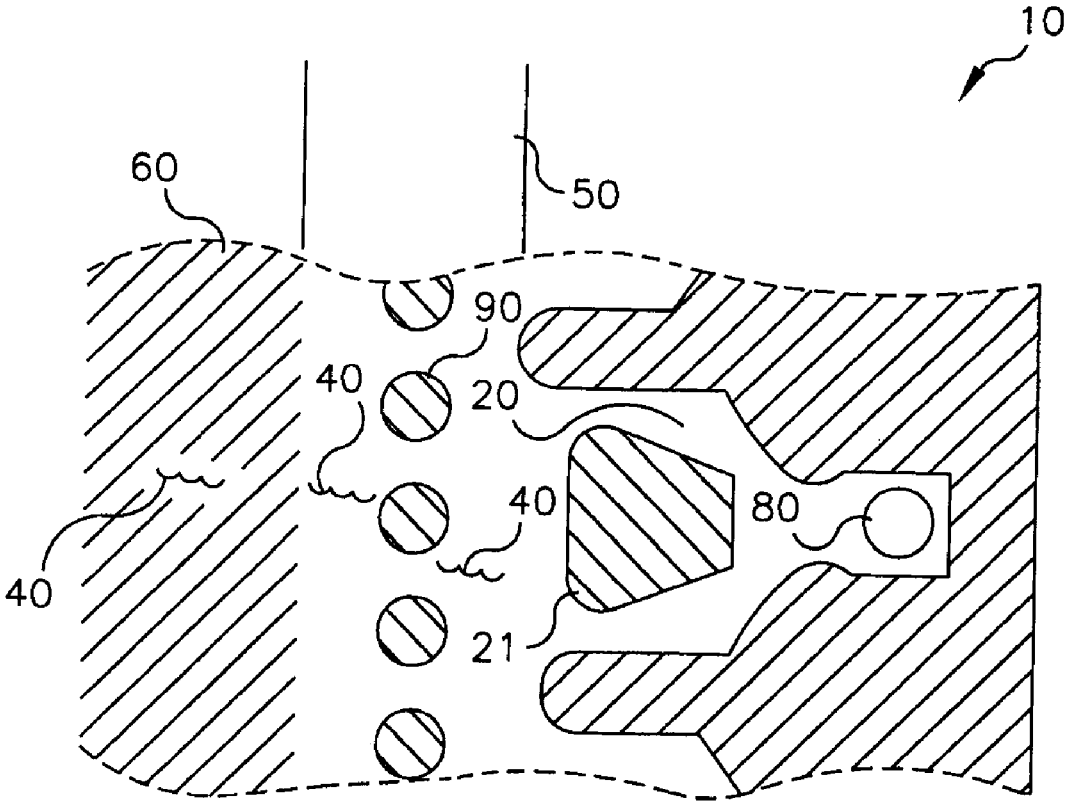
FIG. 1A (PRIOR ART)
FIG. 1A is a partial planar view of an internal structure of a prior art liquid drop ejector.

Referring to FIG. 1A, detailed is a greatly magnified partial planar view of a liquid drop ejector 10 (prior art). A liquid chamber 20 exists to forcibly eject a liquid 40 from liquid chamber 20 through nozzle bore 80 for a wide variety of purposes such as image reproduction. Chamber block 21, is a feature that is used for over-damping the meniscus ringing within the liquid drop ejector 10. Liquid 40 is supplied from the liquid supply area 60 through a common area 50, and flows past pillars 90 that are used to trap particles that could plug liquid chamber 20 and/or nozzle bore 80 thus rendering a portion of the liquid drop ejector useless. It is commonplace for practitioners of the art to use pillars 90 for the purpose of filtering and support.

Figure 1B:
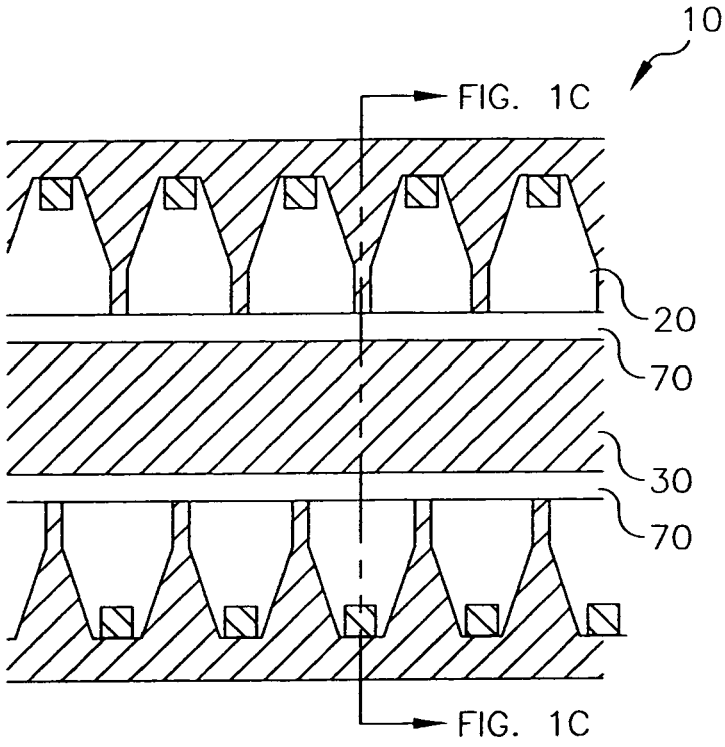
FIG. 1B (PRIOR ART)
FIG. 1B is a second partial planar view of an internal structure of a prior art liquid drop ejector.

FIG. 1B is a partial planar view of a liquid drop ejector 10 (prior art). Block 30 is designed to prevent problems that are caused by air bubbles that are formed in the printhead. The liquid supply passageway 70 exists between the block 30 and the liquid chamber 20. It is instructive to note that there is a lack of a common area 50 that is detailed in FIG. 1A.

Figure 1C:
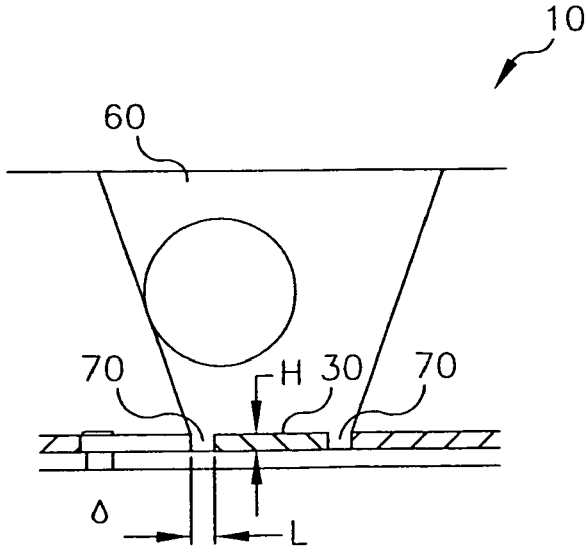
FIG. 1C (PRIOR ART)
FIG. 1C is a cross-sectional side view of the internal structure of the prior art liquid drop ejector of FIG. 1B taken along line 1C-1C.

Referring next to FIG. 1C, shown is a cross-sectional view of the partial planar view detailed in FIG. 1B. Note that by virtue of block 30 there exists a pair of well-defined liquid supply passageways 70. These liquid supply passageways 70 run along the whole length of the liquid drop ejector 10 (prior art). A liquid supply 60 exists for the supply of ink for the liquid drop ejector 10 (prior art).

Figure 1D:
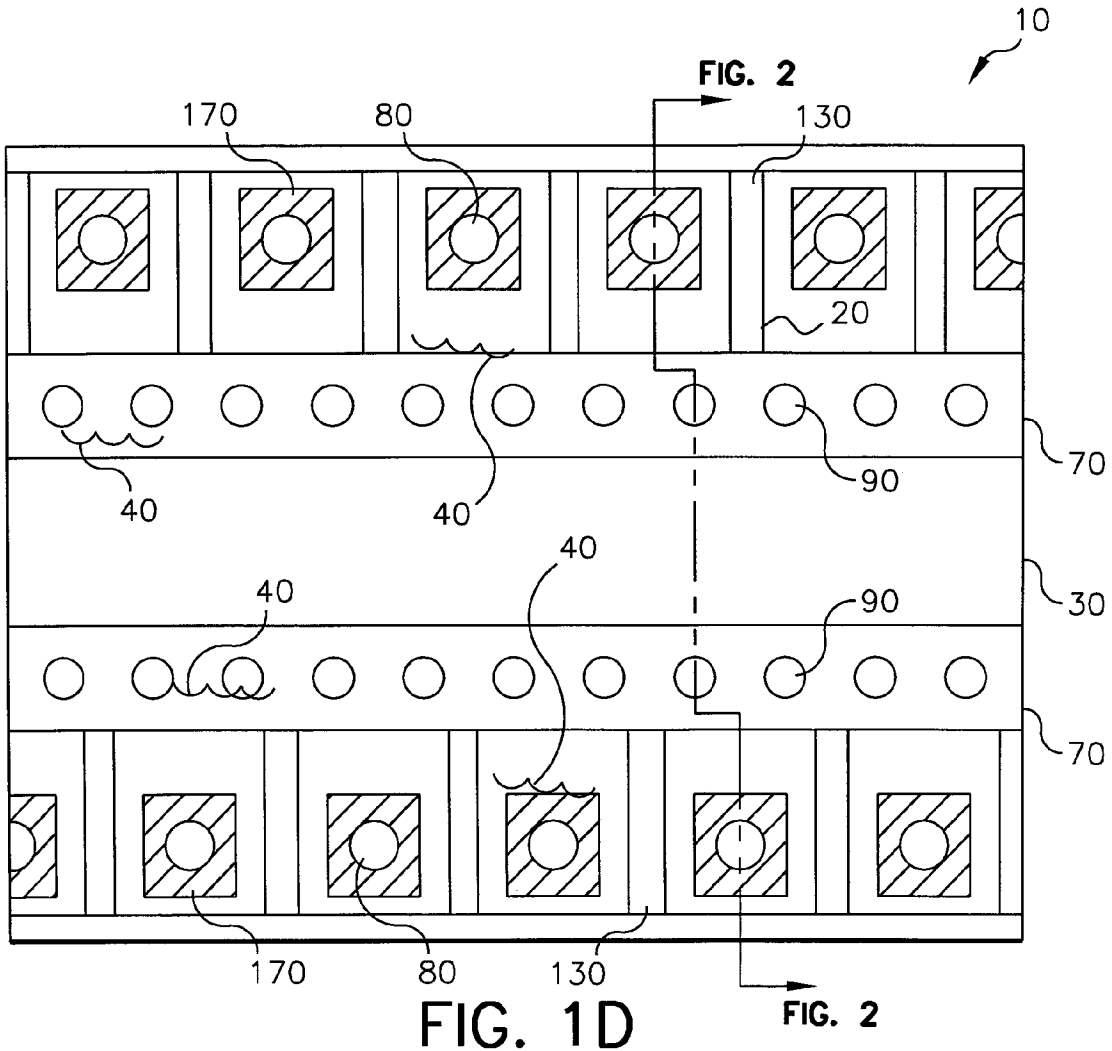
FIG. 1D is a partial planar view of the liquid drop ejector of the present invention showing a cross-section along line FIG. 2-FIG. 2.

FIG. 1D details a partial planar view of the liquid drop ejector 10 of the present invention. Heater 170 exists to eject a liquid 40 through the nozzle bore 80 of the liquid drop ejector 10. Liquid chambers 20 exist by virtue of chamber walls 130 that serve to isolate the plurality of liquid chambers 20 physically from each other. In the case of the present invention, the plurality of pillars 90 is suspended within the liquid supply passageways 70, and adjacent rows of liquid chambers 20 are isolated by the block 30. In FIG. 1D, more than one pillar 90 is positioned within the liquid supply passageway 70 so as to be associated with an individual liquid chamber 20. Two pillars 90 are shown in FIG. 1D for illustrative purposes only. It should be understood that more than two pillars 90 can be positioned within the liquid supply passageway 70 and associated with an individual liquid chamber 20.

Figure 1E:
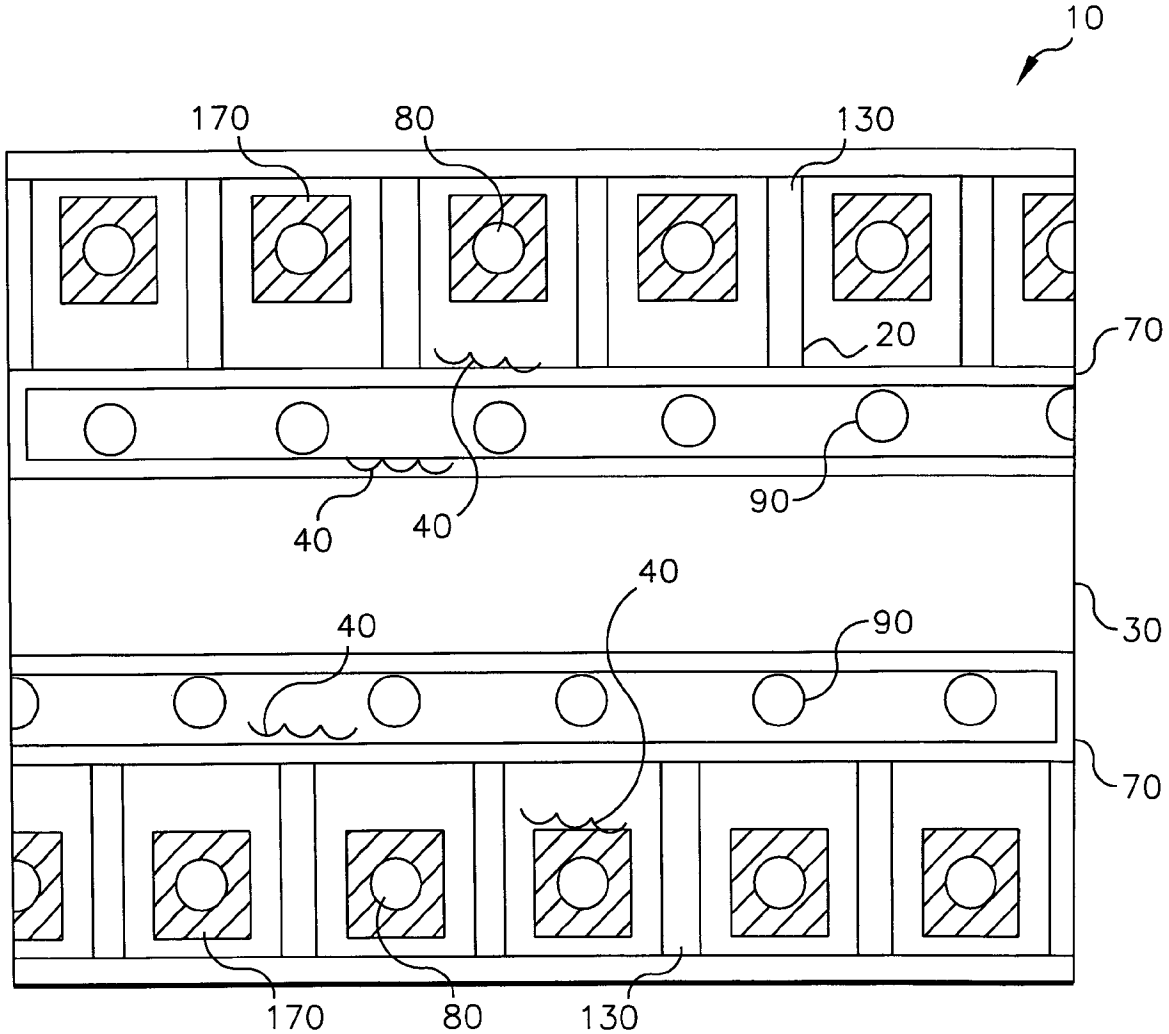
FIG. 1E is another partial planar view of the liquid drop ejector of the present invention showing a cross-section along line FIG. 2-FIG. 2.

Other pillar 90 and liquid chamber 20 associations can occur depending on the contemplated application of the liquid drop ejector 10. For example, and referring to FIG. 1E, the plurality of pillars 90 is positioned within the liquid supply passageway 70 such that each pillar of the plurality of pillars 90 is associated with an individual liquid chamber 20.

Figure 2:
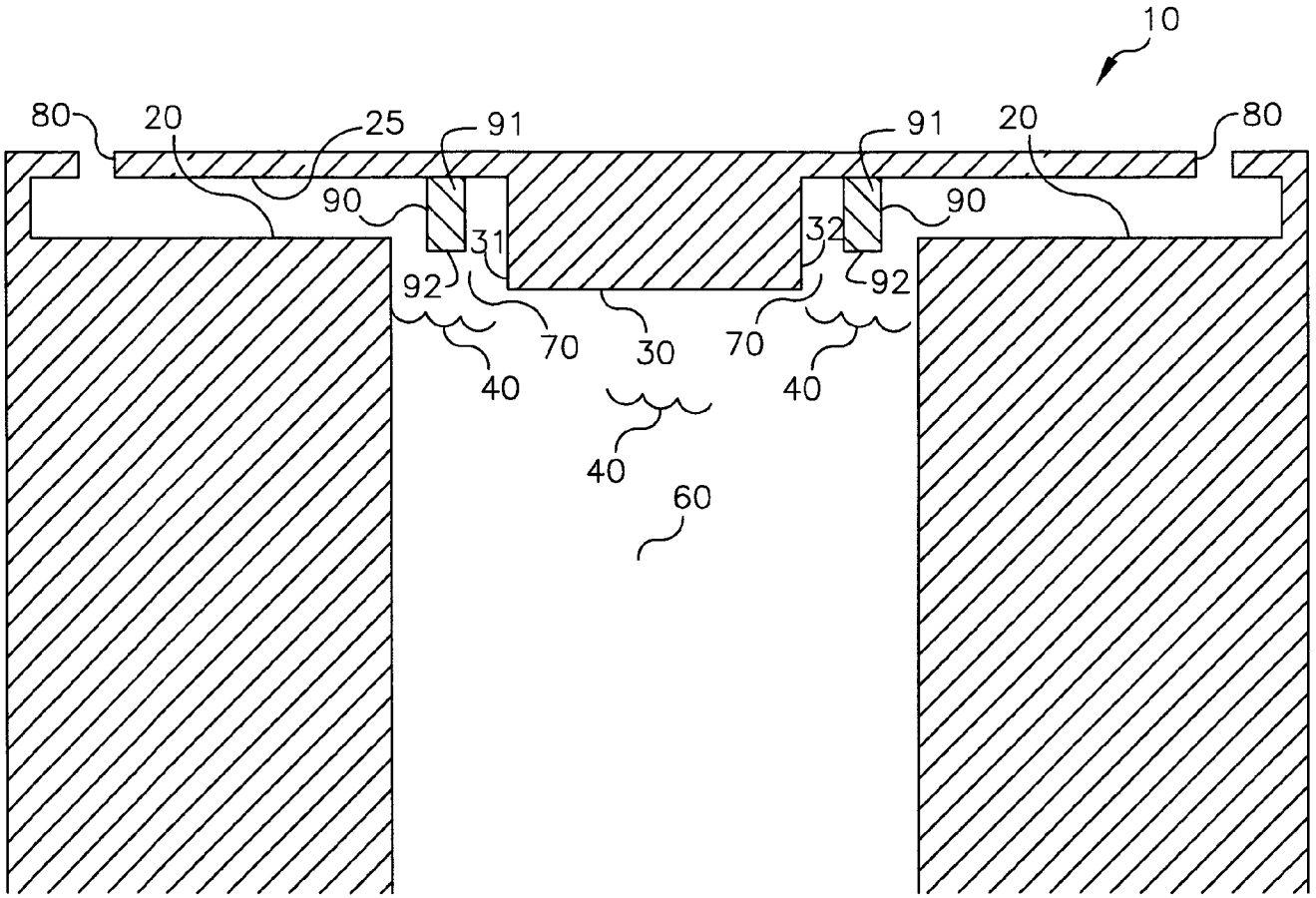
FIG. 2 is a cross-sectioned side view of the internal structure of the liquid drop ejector detailed in FIG. 1D.

FIG. 2 details a cross-sectional view of a liquid drop ejector 10 previously detailed in FIG. 1D, and shows the suspension of the pillars 90 directly within the liquid supply passageway 70, upon a wall 25 that is substantially perpendicular to the nozzle bore 80. Note again, that the suspension of the pillars 90 within the fluid supply passageway 70, allows a shorter liquid chamber 20 by moving the pillars 90 out of the prior art common area 50 (FIG. 1A) of the liquid drop ejector 10. Moving the pillars 90 out of the prior art common area 50 frees up this space and allows for its complete removal. The removal of the prior art common area 50 allows the shortening of the liquid chamber 20, thus reducing the distance that liquid 40 is required to flow thus reducing refill times while still preserving effective filtering of the liquid 40.

As depicted in FIG. 2, the liquid drop ejector 10 comprises:

- a liquid chamber 20 having a roof (110 shown in FIG. 8), portions of the liquid chamber defining a nozzle bore 80;
- a liquid supply area 60 beneath the roof (110 shown in FIG. 8) and including a block 30 suspended from the roof into the liquid supply area such that a liquid supply passageway 70 is defined at opposite sides 31 and 32 of the block to extend between the liquid chamber 20 and the liquid supply area, the liquid supply passageway being in fluid communication with the liquid chamber and the liquid supply area and including a wall 25; and
- a plurality of pillars 90 suspended in the liquid supply passageway 70 such that at least one of the plurality of pillars has one end 91 attached to the wall 25 of the liquid supply passageway and another end 92 at least partially freely overhanging the liquid supply area 60.

Figure 3:
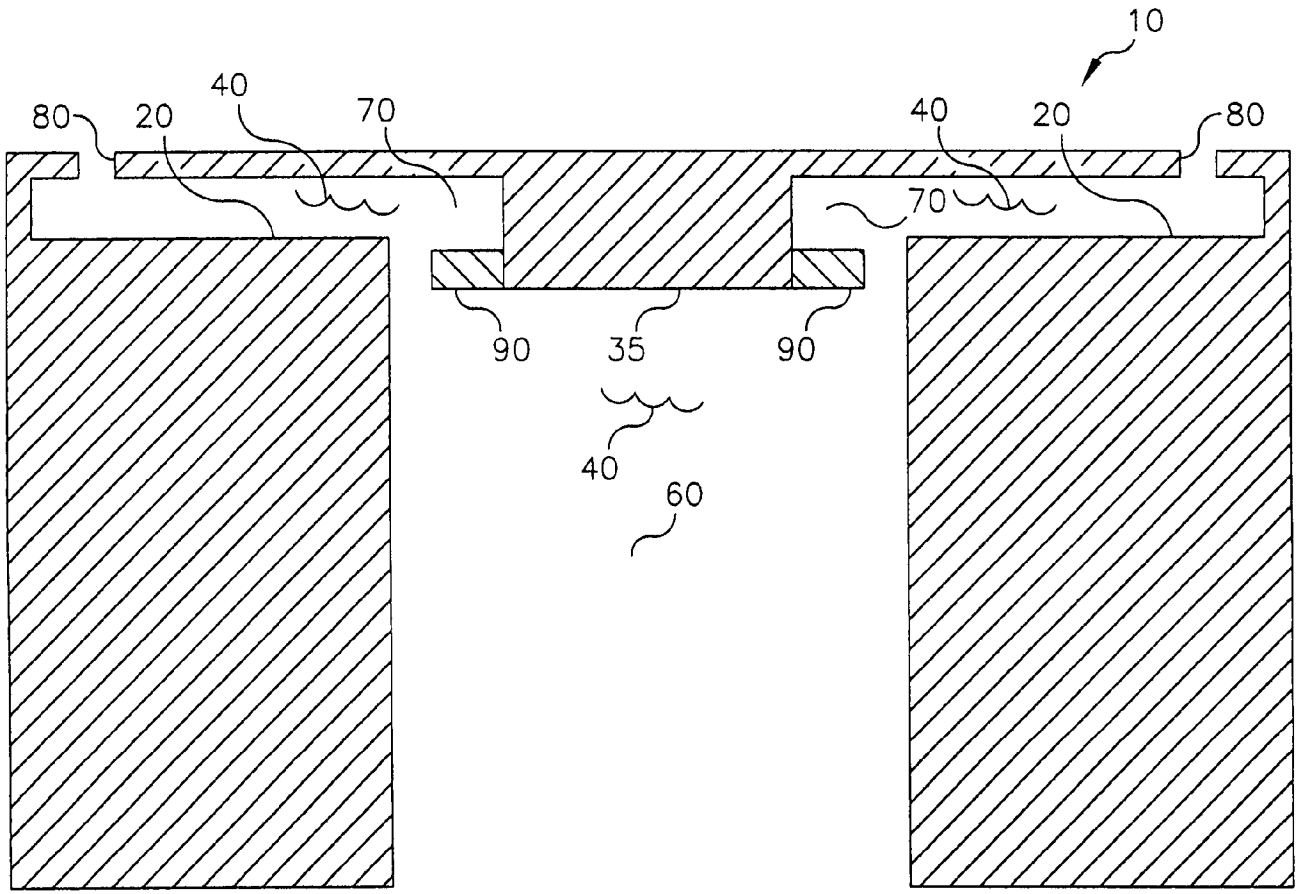
FIG. 3 is a side view of the liquid drop ejector of the present invention detailing a plurality of pillars suspended from the wall of the liquid supply passageway.
Figure 4:
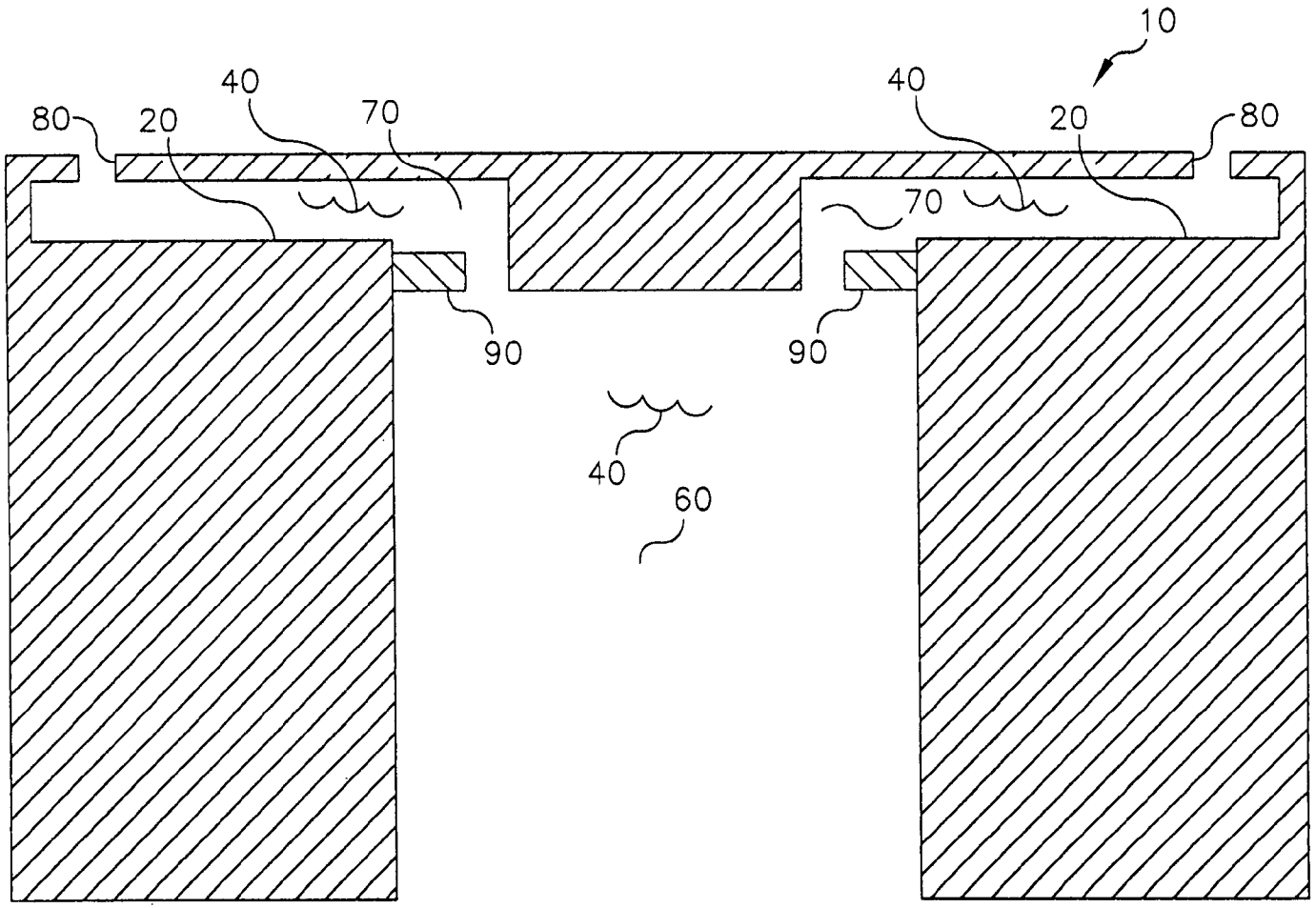
FIG. 4 is a side view of the liquid drop ejector of the present invention detailing a second placement of the pillars suspended from the wall of the liquid supply passageway.

Referring now to FIG. 3, detailed is a cross-sectional view of a liquid drop ejector 10 of the present invention. The liquid supply passageway 70 is containment for fluid 40. This being understood, the fluid supply passageway 70 has walls that are both perpendicular and parallel to the nozzle bore 80. Referring again to FIG. 3, a plurality of pillars 90 is shown residing upon a first perpendicular wall of the fluid supply passageway 70; upon a wall 35 that is substantially parallel to the nozzle bore 80. Next referring to FIG. 4 pillars 90 are shown residing upon a second perpendicular wall of the fluid supply passageway 70. FIG. 2 details pillars 90 that reside upon a wall that is substantially parallel to the nozzle 80.

Figure 5:
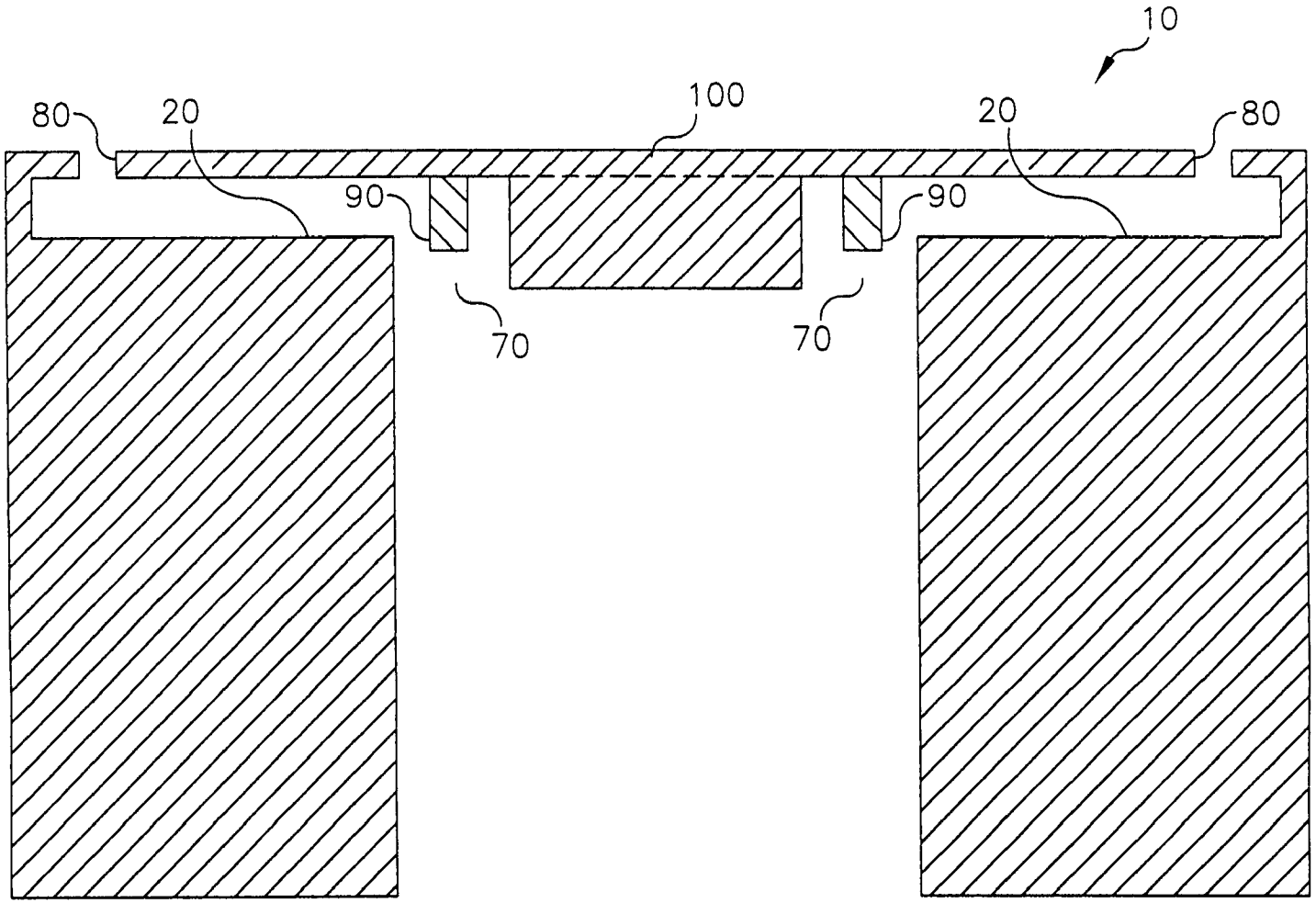
FIG. 5 is a side view of the liquid drop ejector of the present invention detailing another placement of the pillars suspended from the wall of the liquid supply passageway, the drop ejector comprising a nozzle plate.

Referring now to FIG. 5, detailed is a cross-sectional view of a liquid drop ejector 10 of the present invention. In this diagram, a separate nozzle plate 100 is attached along the dashed line to form a roof for the liquid drop ejector 10. Nozzle plate 100 also contains both the liquid supply chamber 20 and the liquid supply passageway 70. Pillars 90 are shown suspended from the nozzle plate 100. It should be understood at this time that pillars 90 can be suspended in the liquid supply passageway 70 both in a plane perpendicular to the nozzle bore 80 as in FIG. 3, and a plane parallel to the nozzle bore 80 as shown in FIG. 2.

Figure 6:
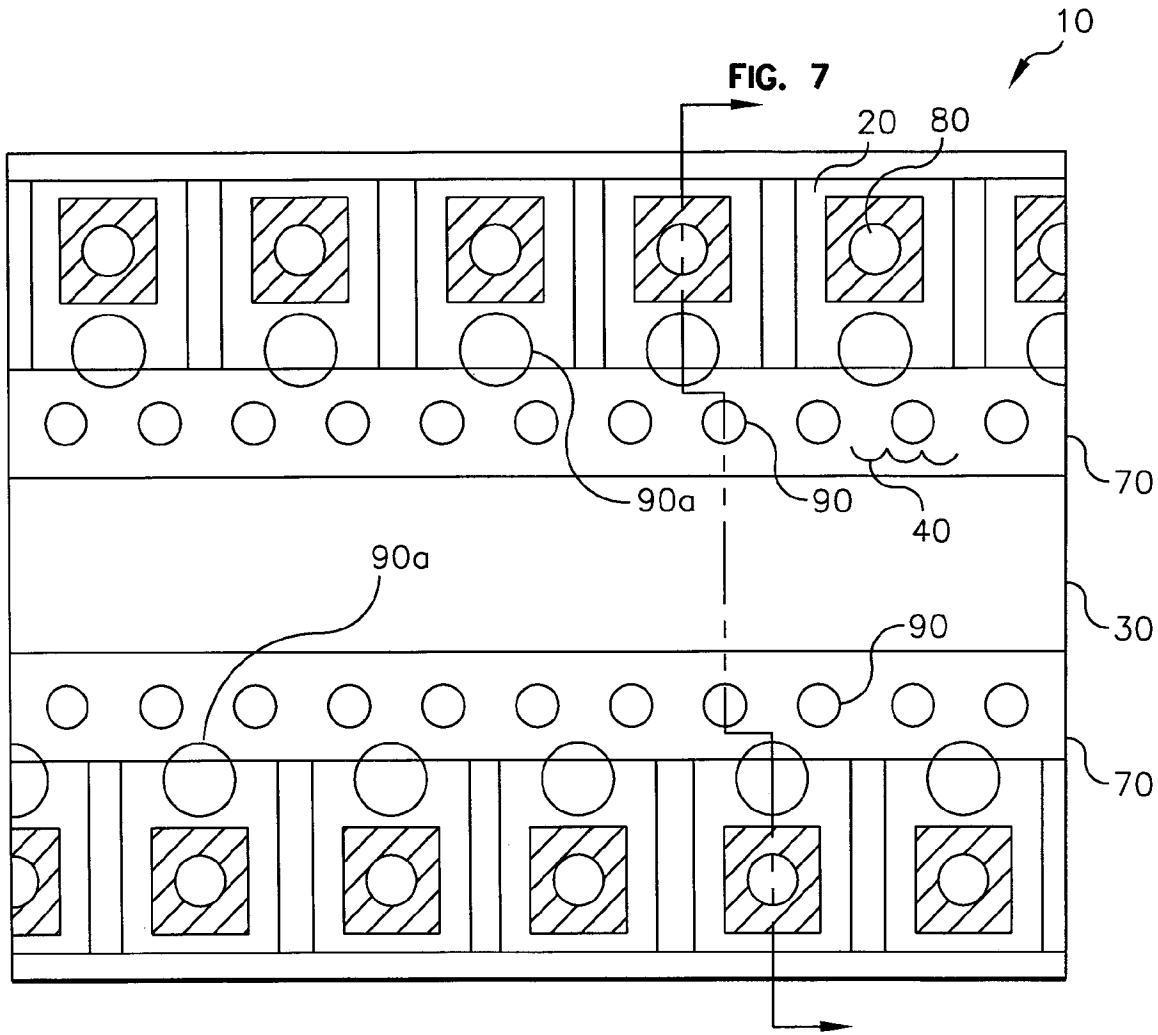
FIG. 6 is a partial planar view of the internal structure of the liquid drop ejector of the present invention, showing a center pillar associated with the liquid drop ejector.

Referring to FIG. 6, detailed is a greatly magnified partial planar view of a liquid drop ejector 10 of the present invention. A liquid chamber 20 exists to forcibly eject a liquid 40 from liquid chamber 20 through nozzle bore 80 for a wide variety of purposes such as image reproduction. Note that by virtue of block 30 there exists a pair of well-defined liquid supply passageways 70. These liquid supply passageways 70 run along the whole length of the liquid drop ejector 10.

Liquid 40 is supplied via a liquid supply passageways 70, and flows past pillars 90 that are used to trap particles that could plug liquid chamber 20 and/or nozzle bore 80 thus rendering a portion of the liquid drop ejector useless. It is commonplace for practitioners of the art to use pillars 90 for the purpose of filtering and support. These pillars 90 exist in a prior art common area 50 (FIG. 1A) that exists between the liquid chamber 20 and the liquid supply passageway 70. The placement of pillars 90 within the liquid supply passageway 70, instead of the prior art common area 50 (FIG. 1A) produces significantly enhanced refill, while still preserving effective filtering. This suspension of pillars 90 directly within the liquid supply passageway 70, as opposed to the prior art placement of these pillars 90 within the prior art common area 50 (FIG. 1A), allows for a shorter distance that the liquid 40 is required to flow to refill the liquid chamber 20. Thus, the refilling time of the liquid chamber 20 of the liquid drop ejector 10 is substantially improved. Referring also to FIG. 6, there exists a center pillar 90*a* wherein a first portion of the center pillar 90*a* is positioned within the liquid chamber and wherein a second portion of the center pillar 90*a* is positioned within the liquid supply passageway 70.

Figure 7:
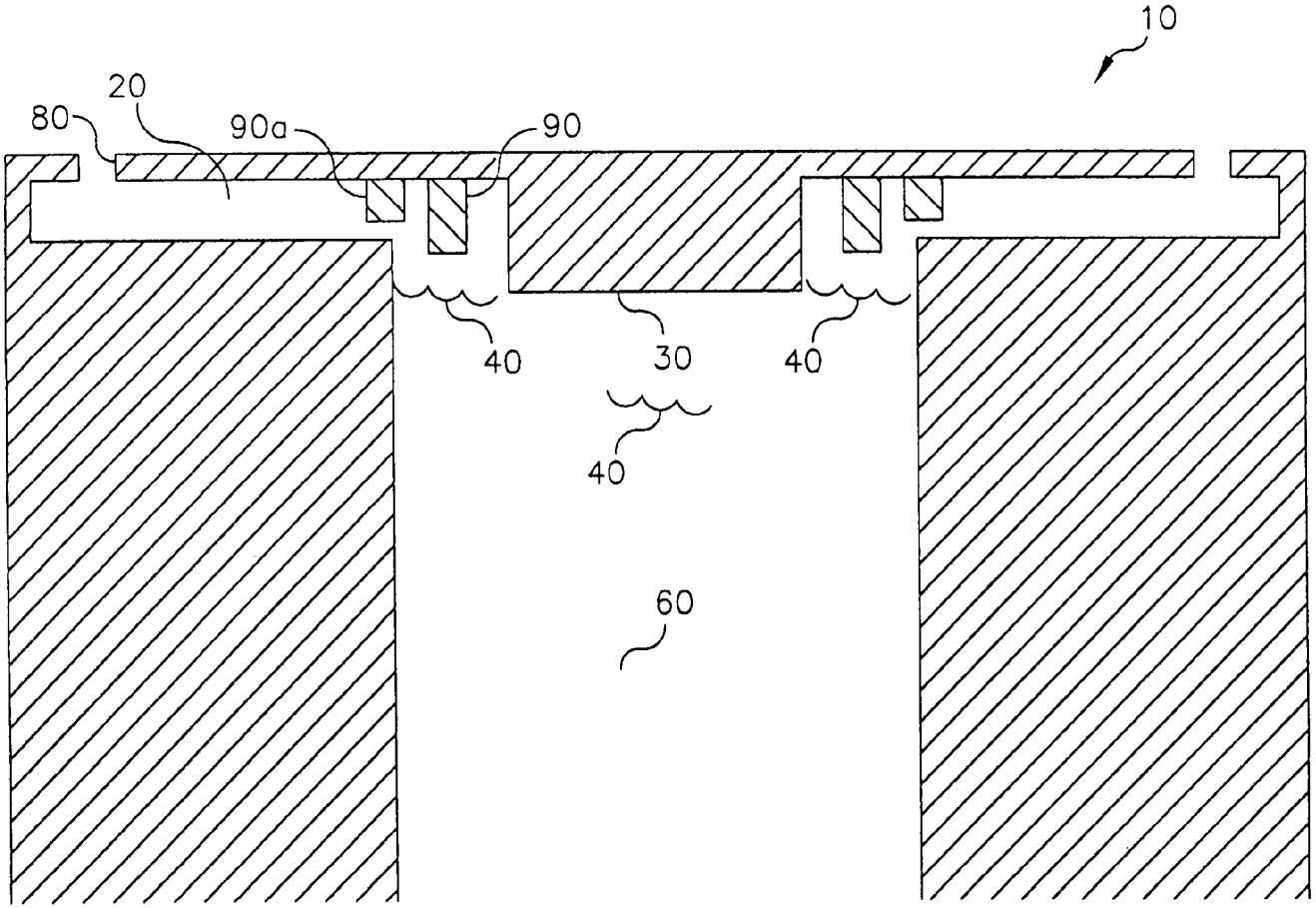
FIG. 7 is an alternate cross-sectional side view of the internal structure of the liquid drop ejector detailed in FIG. 6.

FIG. 7 details a cross-sectional view of a liquid drop ejector 10 previously detailed in FIG. 6, and shows the suspension of the pillars 90 directly within the liquid supply passageway 70. Note again that the suspension of the pillars 90 within the liquid supply passageway 70 allows a shorter liquid chamber 20 by moving the pillars 90 out of the prior art common area 50 (FIG. 1A) of the liquid drop ejector 10. Referring also to FIG. 7, there exists a center pillar 90*a* wherein a first portion of the center pillar 90*a* is positioned within the liquid chamber 20 and wherein a second portion of the center pillar 90*a* is positioned within the liquid supply passageway 70.

Figure 8:
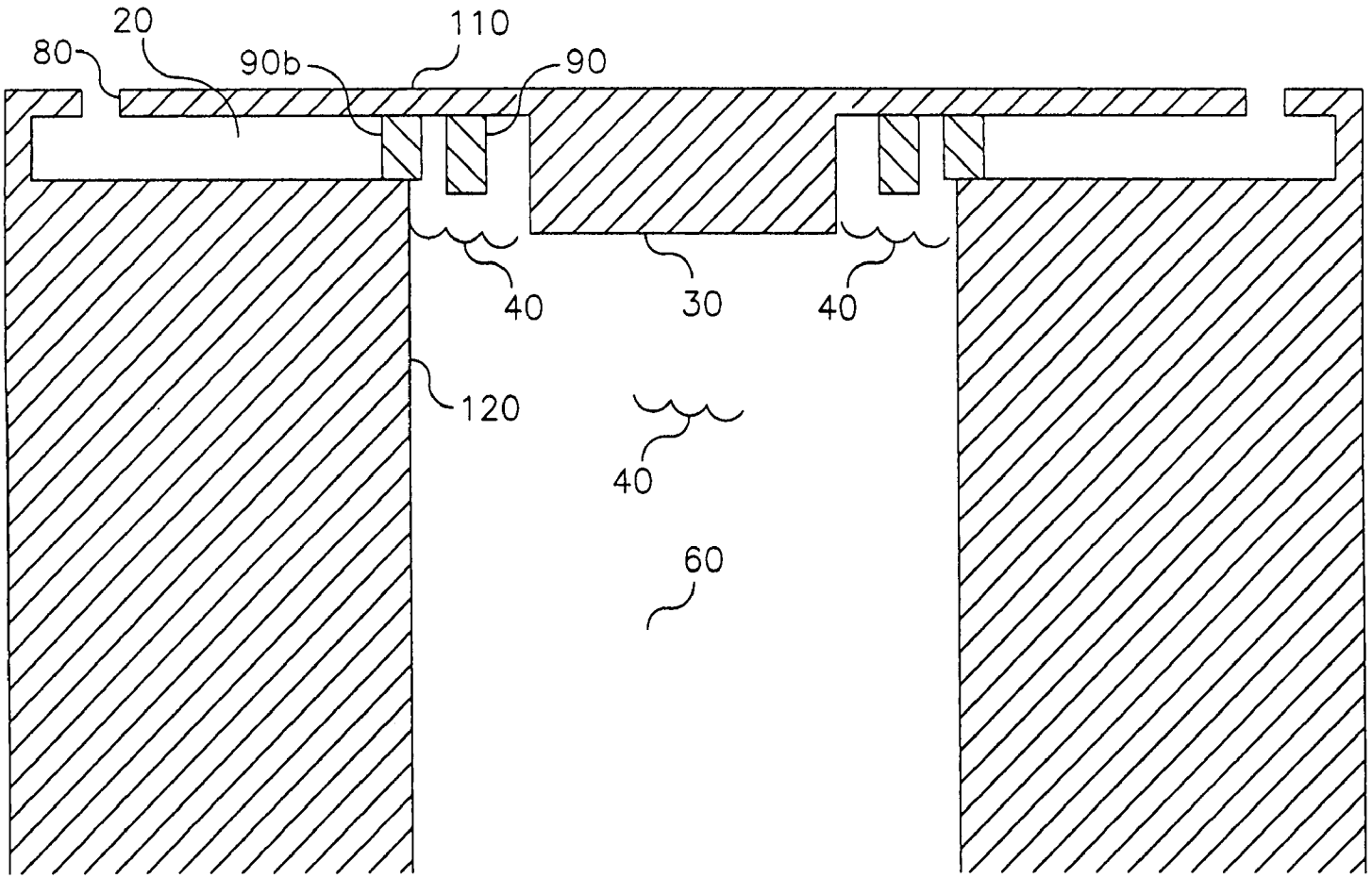
FIG. 8 is cross-sectional side view of a second internal configuration of the liquid drop ejector detailed in FIG. 7.

Referring to FIG. 8, detailed is a center pillar 90*b* positioned within the liquid supply passageway 70 of the liquid drop ejector 10. Pillar 90*b* has a top and a bottom (two ends). The top end of the pillar 90*b* is attached to a first wall (or roof 110) of the liquid supply passageway 70, and the bottom end is attached to a second wall (or floor 120) of the liquid supply passageway 70. A first portion of the second end (bottom) of pillar 90*b* is positioned within the liquid chamber 20, and a second portion of the second end (bottom) of pillar 90*b* is positioned within the liquid supply passageway 70.

Figure 9:
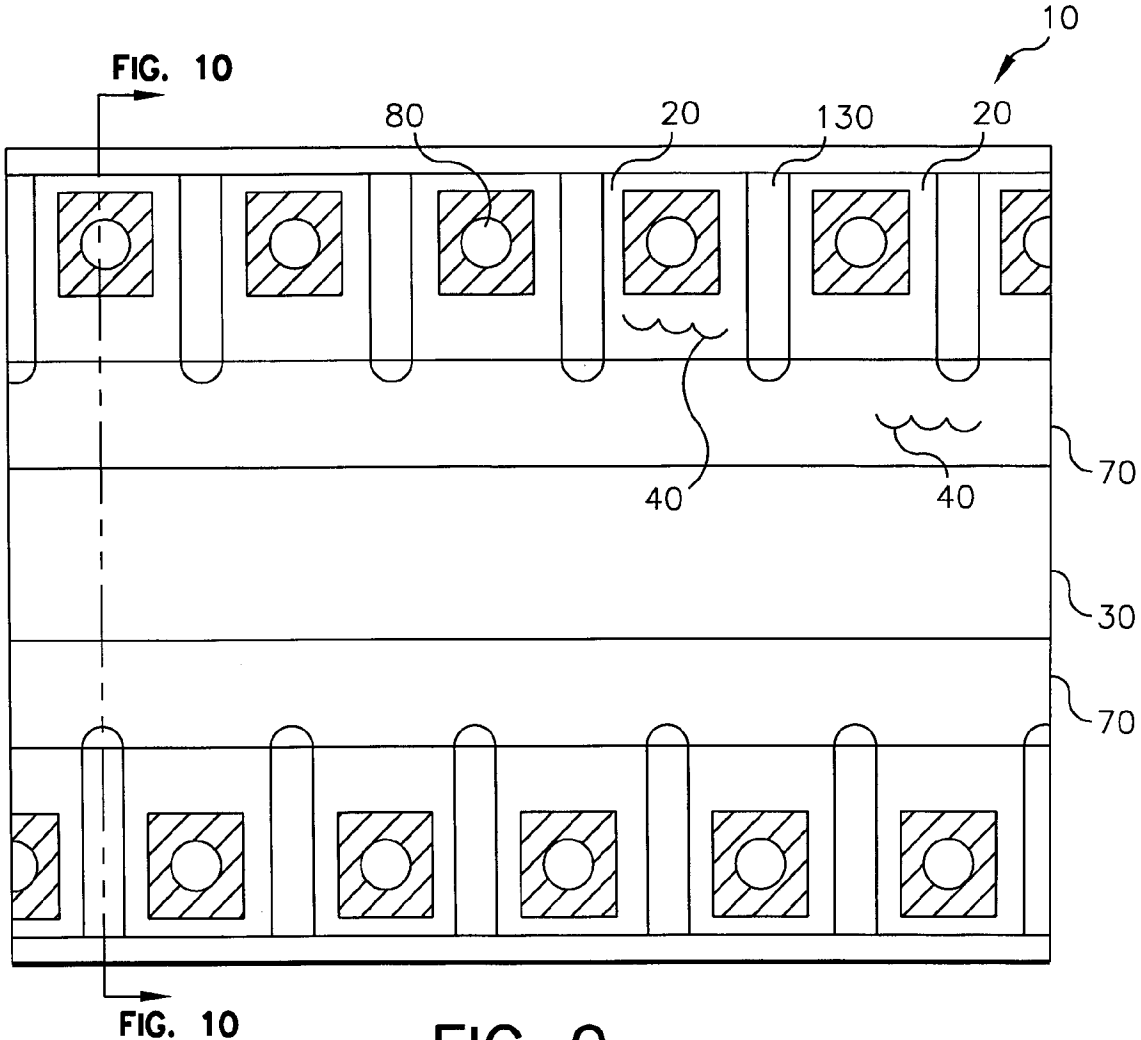
FIG. 9 is a partial planar view of the internal structure of the liquid drop ejector of the present invention.

Referring to FIG. 9, detailed is a greatly magnified partial planar view of a liquid drop ejector 10 of the present invention. A liquid chamber 20 exists to forcibly eject a liquid 40 from liquid chamber 20 through nozzle bore 80 for a wide variety of purposes such as image reproduction. Note that by virtue of block 30 there exists a pair of well-defined liquid supply passageways 70. These liquid supply passageways 70 run along the whole length of the liquid drop ejector 10.

Liquid 40 is supplied via a liquid supply passageway 70 and is ultimately ejected through nozzle 80. A chamber wall 130 exists as a separation between adjacent liquid chambers 20. The length of the chamber wall 130 has been found to have a positive effect on crosstalk between adjacent liquid chambers 20. The extension of this chamber wall 130 into and over the liquid supply passageway 70 minimizes cross communication, (also known as crosstalk) of fluids between the adjacent chambers 20.

It should be understood at this point that the main physical cause for crosstalk is the impulsive motion of the liquid due to the acceleration of the fluid interface with a vapor bubble during its generation and growth. Previous approaches to minimize this inter-nozzle coupling and subsequent interaction vary widely. One example is inertial decoupling where feed channels are made long and slender. Another example is capacitive decoupling, where an extra hole is placed within a nozzle plate to damp pressure surges by allowing the meniscus within this dummy nozzle to oscillate rather than the meniscus at an ejection nozzle. Others use elaborate constrictions and expansions within the fluid chamber to help achieve this goal. Given the high nozzle density and the high frequency of operation requirements of current liquid ejectors, all the above-mentioned solutions are marginal at best.

The present invention provides a solution that allows high packing density while significantly decoupling adjacent nozzles. The extension of the chamber walls 130 of the liquid chambers 20 slightly into the liquid supply passageway 70 along with the removal of the problematic prior art common area 50 (FIG. 1A) that was discussed in FIG. 2. It needs to be understood at this point that filtering through the prior art common area 50 (FIG. 1A), using a variety of shaped filter elements as is practiced in the art, is extremely detrimental for crosstalk because it maintains a commonality of high-pressure regions between adjacent nozzles. The elimination of the prior art common area 50 (FIG. 1A), and the extension of the chamber walls 130 of the liquid chambers 20 slightly into the liquid supply passageway 70, brings success in drastically eliminating crosstalk. This occurs because we direct the impulsive motion of the liquid 40 to face the inherently much larger low-pressure area of the liquid supply passageway 70 rather than the inherently higher-pressure area of the prior art common area 50 (FIG. 1A) as discussed in FIG. 2. This fact causes the liquid 40 to have a significantly harder time to push its way into an adjacent liquid chamber 20 with its higher chamber pressure.

Figure 10:
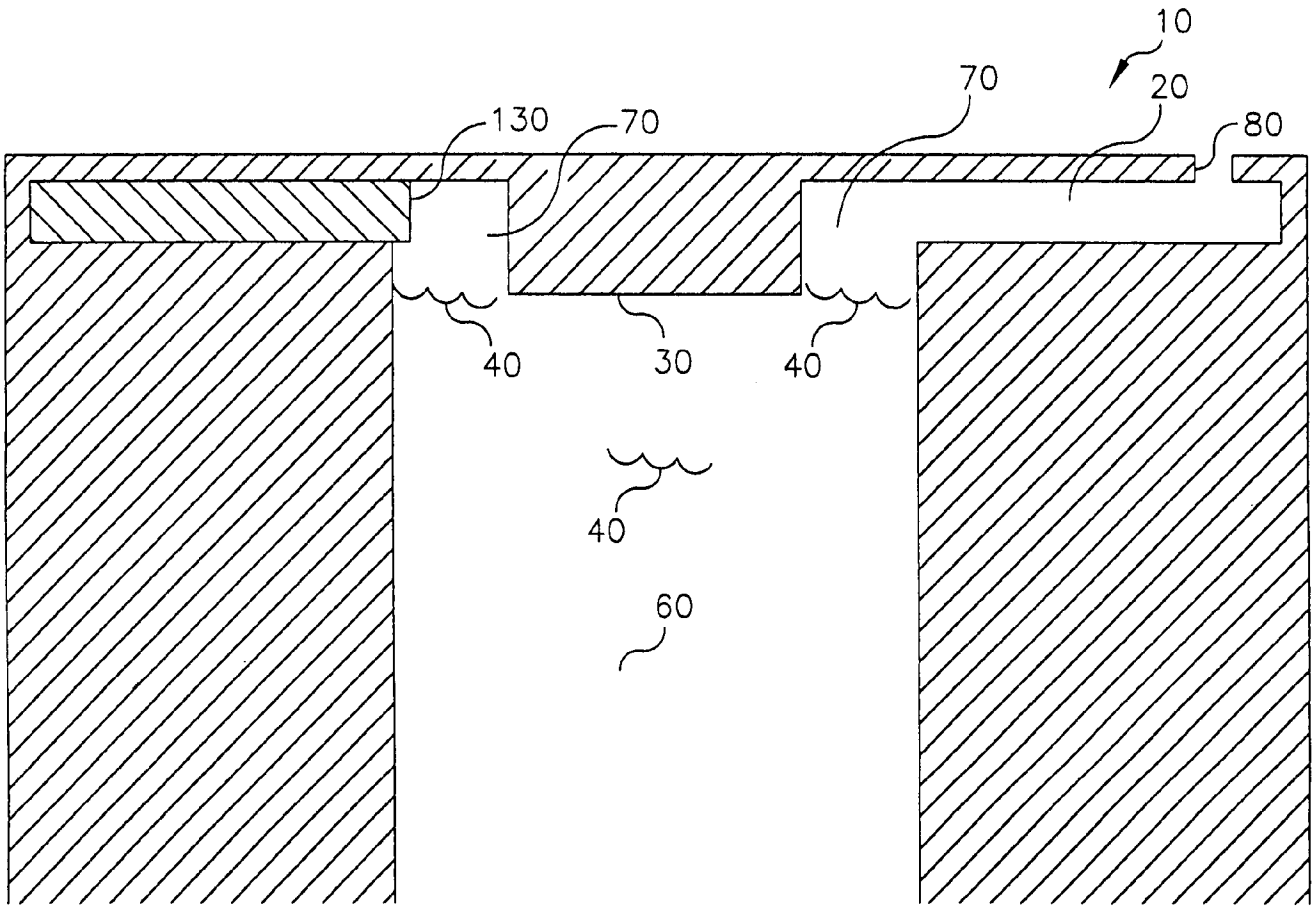
FIG. 10 is a cross-sectioned side view of the internal structure of the liquid drop ejector detailed in FIG. 9.

FIG. 10 details a cross-sectional view of a liquid drop ejector 10 previously detailed in FIG. 9, and shows the extension of the chamber walls 130 into and over the liquid supply passageway 70. Note again that the elimination of the prior art common area 50 (FIG. 1A), and the extension of the chamber walls 130 of the liquid chambers 20 slightly into the liquid supply passageway 70, brings success in eliminating crosstalk for the reasons described in the previous paragraph.

Figure 11:
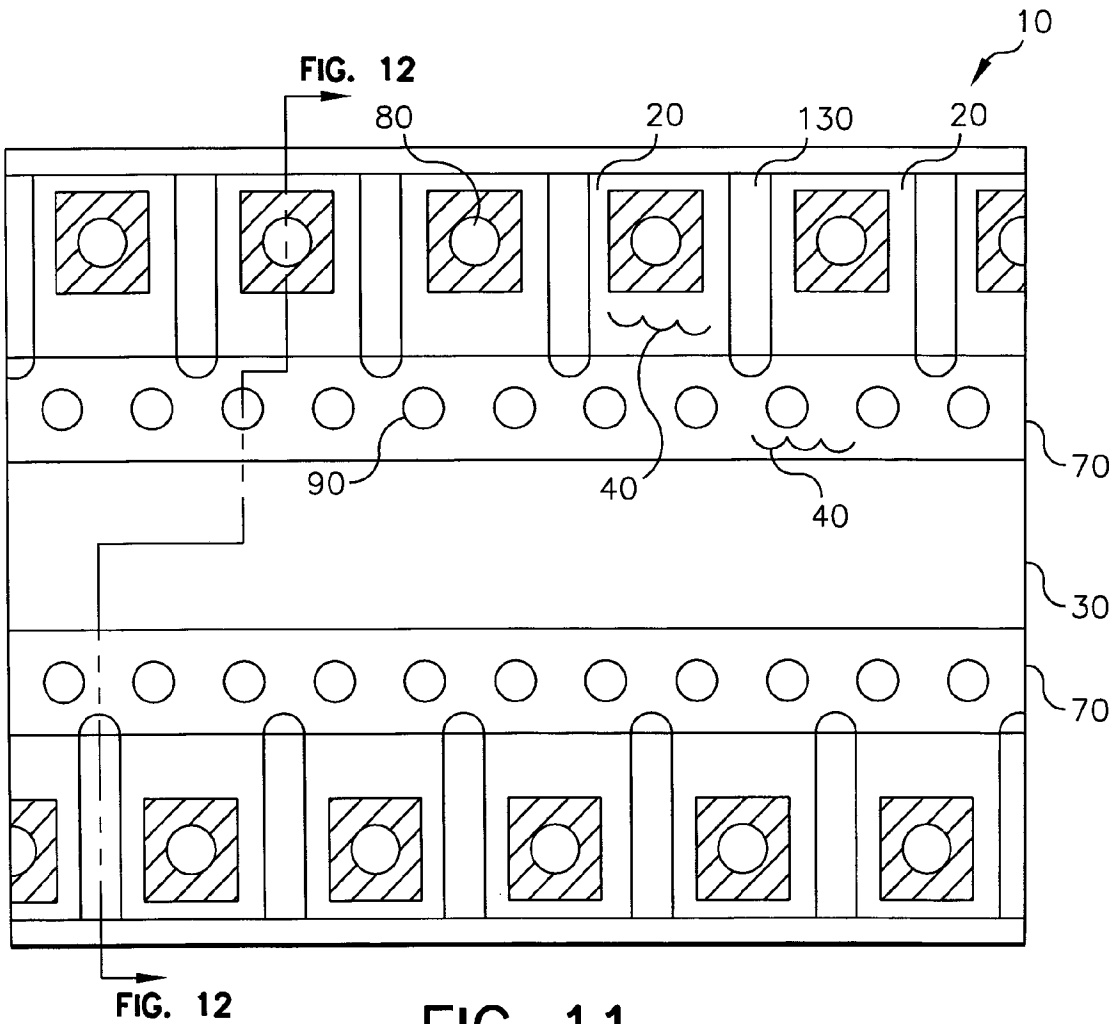
FIG. 11 is a partial planar view of the internal structure of the liquid drop ejector of the present invention detailing pillars suspended in the liquid passageway.

Referring to FIG. 11, detailed is a greatly magnified partial planar view of a liquid drop ejector 10 of the present invention. A liquid chamber 20 exists to forcibly eject a liquid 40 from liquid chamber 20 through nozzle bore 80 for a wide variety of purposes such as image reproduction. Note that by virtue of block 30 there exists a pair of well-defined liquid supply passageways 70. These liquid supply passageways 70 run along the whole length of the liquid drop ejector 10.

Liquid 40 is supplied via a liquid supply passageway 70 and is ultimately ejected through nozzle 80. A chamber wall 130 exists as a separation between adjacent liquid chambers 20. The length of the chamber wall 130 has been found to have a positive effect on crosstalk between adjacent liquid chambers 20. The extension of this chamber wall 130 into and over the liquid supply passageway 70 minimizes cross-communication between adjacent liquid chambers 20 (also known as crosstalk). In addition to this reduction of crosstalk, it is also advantageous to add the capability of filtering. It is commonplace for practitioners of the art to use pillars 90 for the purpose of filtering and support. These pillars 90 exist in a prior art common area 50 that exists between the liquid chamber 20 and the liquid supply passageway 70. The placement of pillars 90 within the liquid supply passageway 70, instead of the prior art common area 50 (FIG. 1A), produces significantly enhanced refill, while still preserving effective filtering. The suspension of pillars 90 directly within the liquid supply passageway 70, as opposed to the prior art placement of these pillars 90 within a prior art common area 50 (FIG. 1A), allows for a shorter distance that the liquid 40 is required to flow to refill the liquid chamber 20. Thus, the refilling time of the liquid chamber 20 of the liquid drop ejector 10 is substantially improved, along with the aforementioned reduction of crosstalk.

Figure 12:
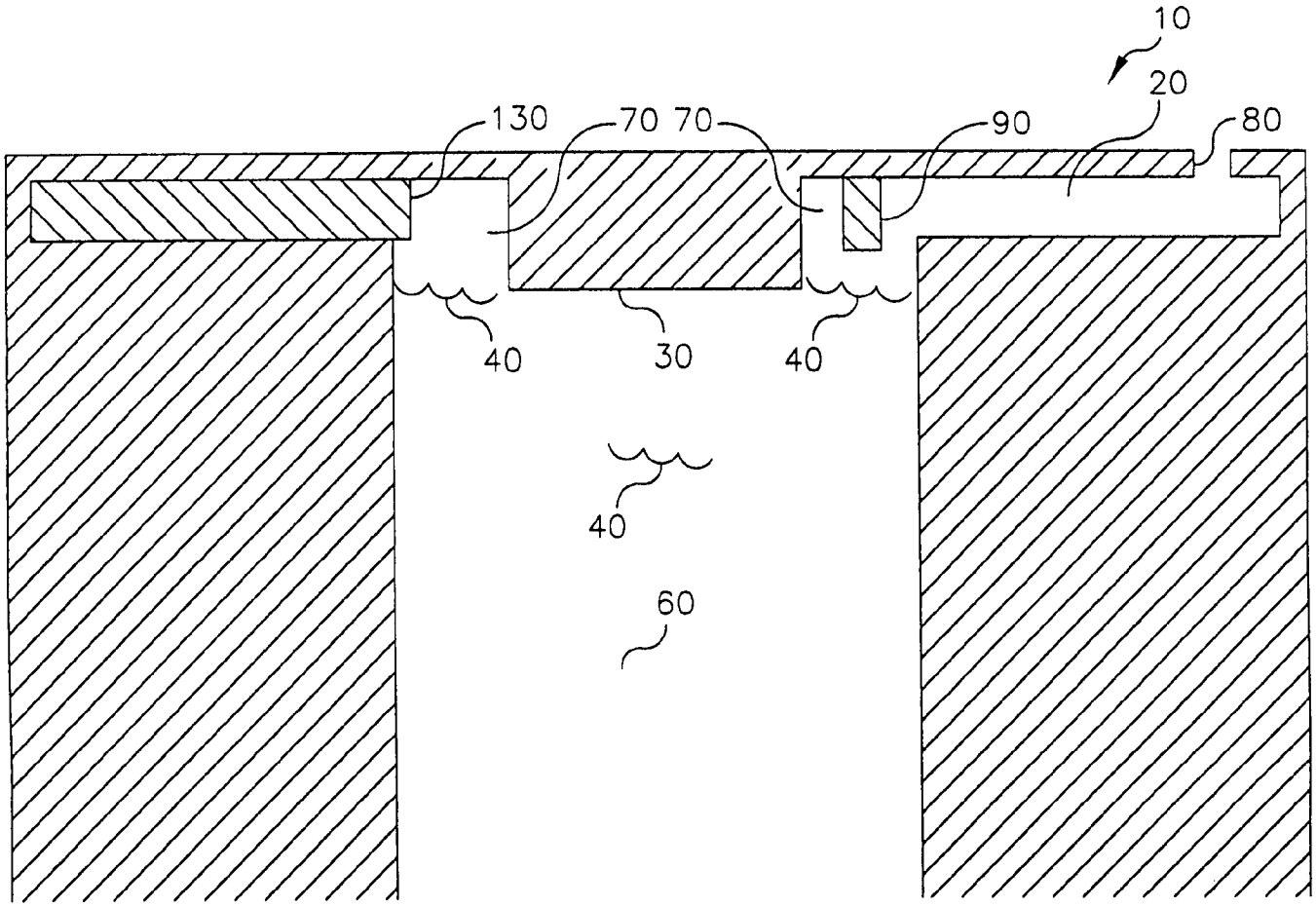
FIG. 12 is a cross-sectioned side view of the internal structure of the liquid drop ejector shown in FIG. 11 detailing pillars suspended in the liquid passageway.

FIG. 12 details a cross-sectional view of the liquid drop ejector 10 previously detailed in FIG. 11, and shows the extension of the chamber walls 130 into and over the liquid supply passageway 70. Note again that the elimination of the prior art common area 50 (FIG. 1A) and the extension of the chamber walls 130 of the liquid chambers 20 slightly into the liquid supply passageway 70 bring success in drastically eliminating crosstalk. Additionally, the placement of pillars 90 within the liquid supply passageway 70, instead of the prior art common area 50 (FIG. 1A) produces significantly enhanced refill, while still preserving effective filtering.

Figure 13:
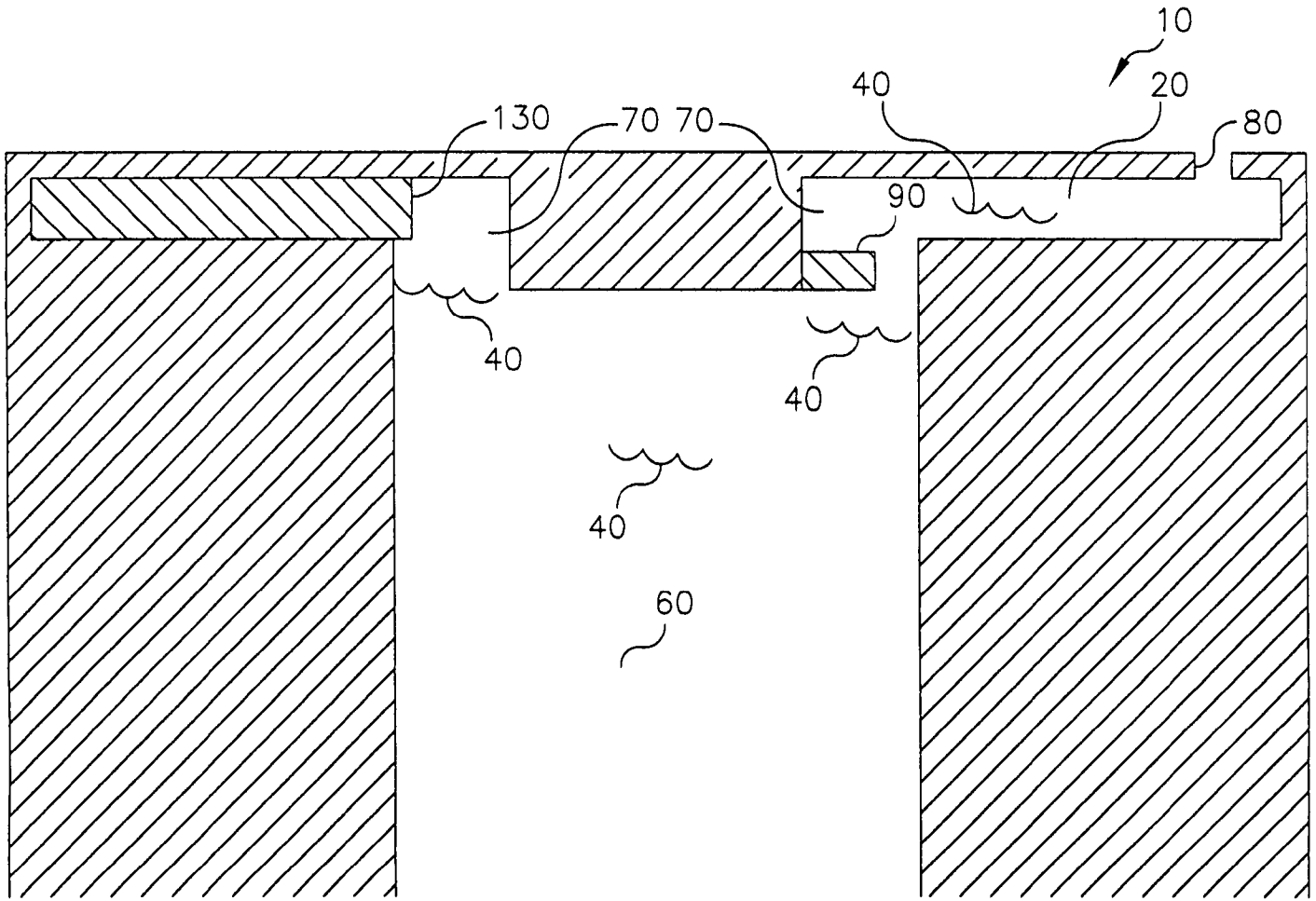
FIG. 13 is a side view of the liquid drop ejector of the present invention detailing pillars suspended from the wall of the liquid supply passageway.
Figure 14:
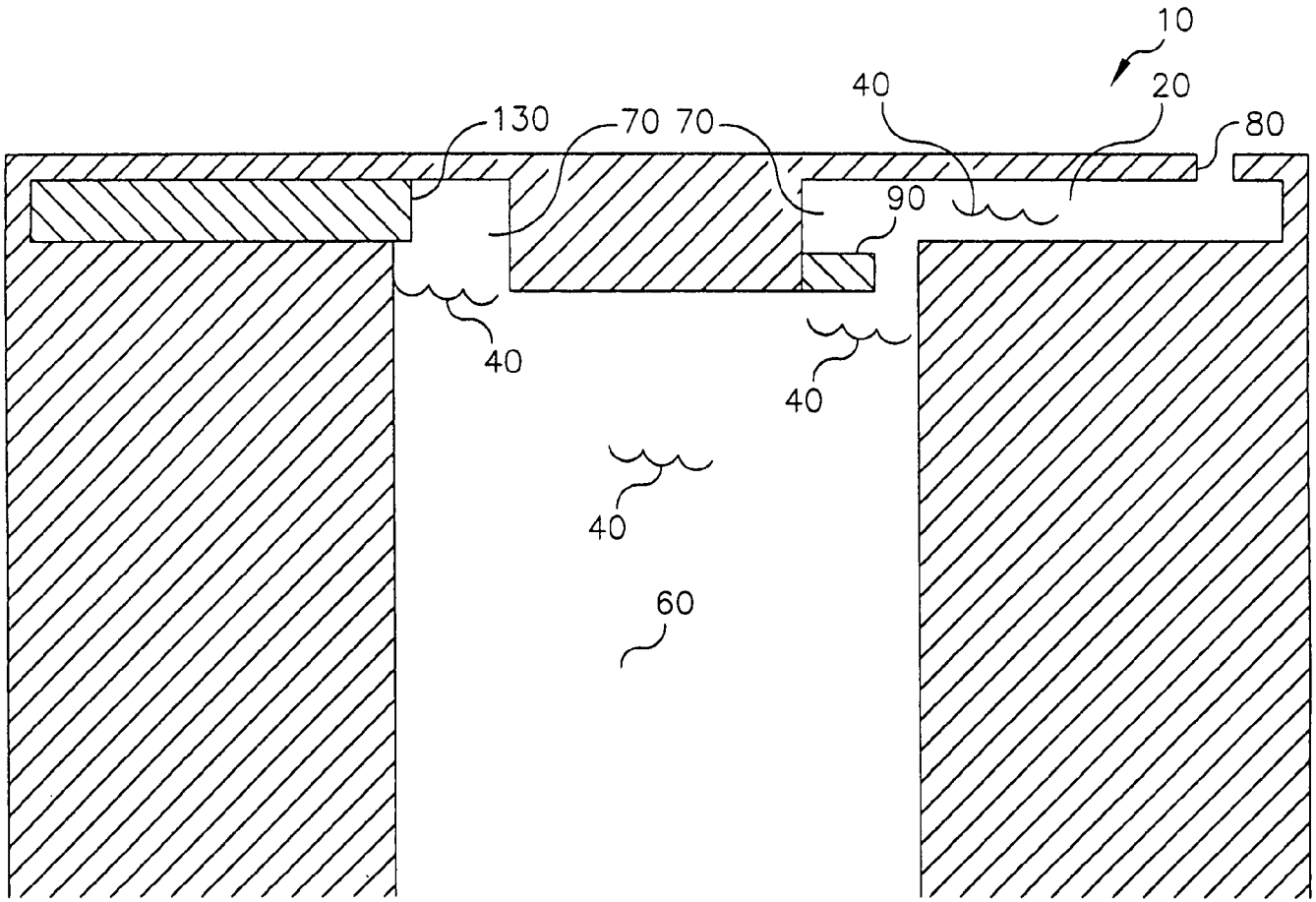
FIG. 14 is a side view of the liquid drop ejector of the present invention detailing a second placement of the pillars suspended from the wall of the liquid supply passageway.

Referring now to FIG. 13, detailed is a cross-sectional view of a liquid drop ejector 10 of the present invention. The liquid supply passageway 70 is containment for fluid 40. This being understood, the fluid supply passageway 70 has walls that are both perpendicular and parallel to the nozzle bore 80. Referring again to FIG. 13, pillars 90 are shown residing upon a first perpendicular wall of the fluid supply passageway 70. Next referring to FIG. 14 pillars 90 are shown residing upon a second perpendicular wall of the fluid supply passageway 70. FIG. 12 details pillars 90 that reside upon a wall that is substantially parallel to the nozzle 80.

Figure 15:
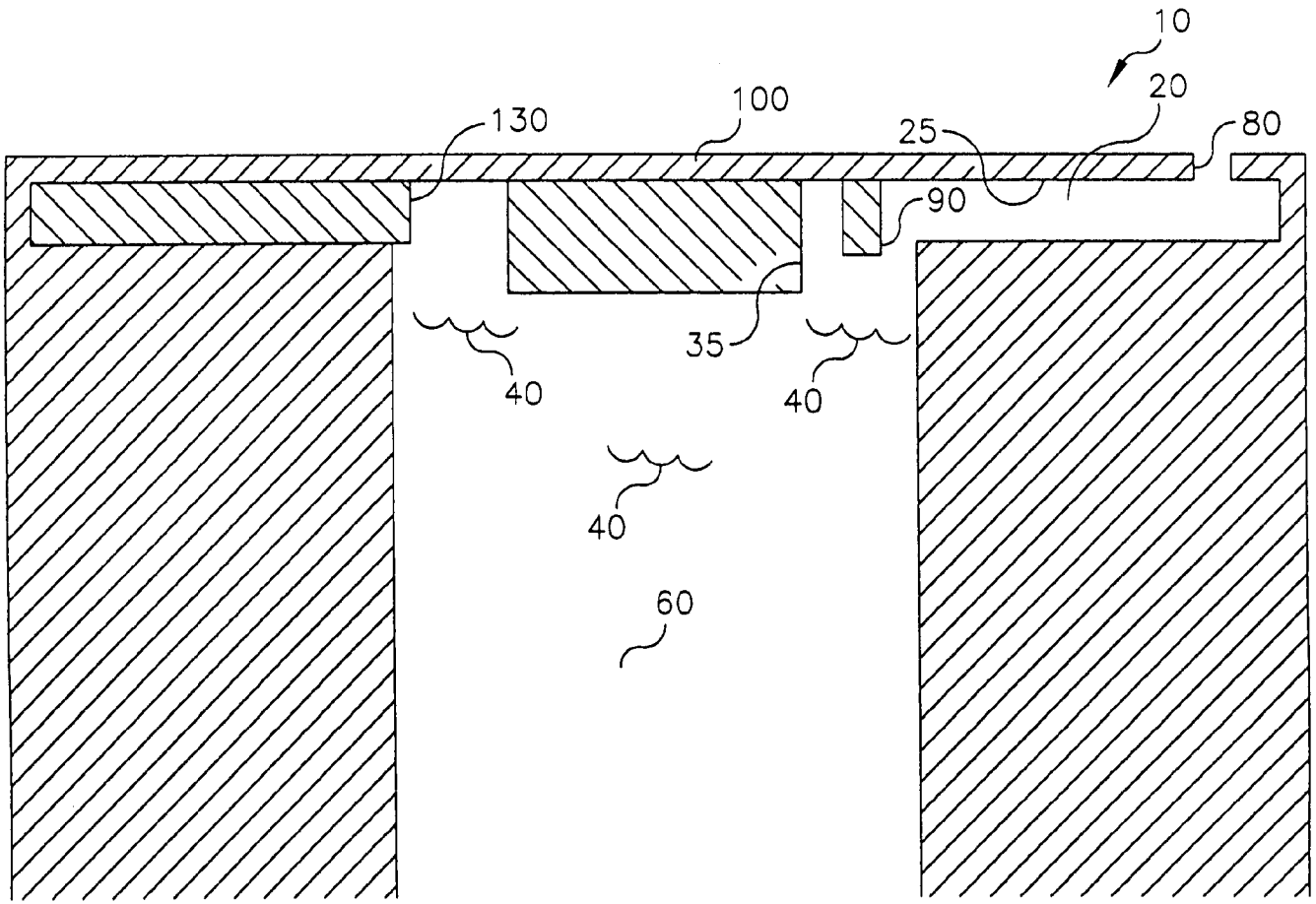
FIG. 15 is a side view of the liquid drop ejector of the present invention detailing the placement of the pillars upon the nozzle plate of a drop ejector, or upon walls that can be parallel or perpendicular to the nozzle bore.

Referring next to FIG. 15, detailed is a cross-sectional view of a liquid drop ejector 10 of the present invention. In this diagram, a separate nozzle plate 100 is attached along the dashed line to form a roof for the liquid drop ejector 10. Nozzle plate 100 also contains both the liquid chamber 20 and the liquid supply passageway 70. Pillars 90 are shown suspended from the nozzle plate 100. It should be understood at this time that pillars 90 can be suspended in the liquid supply passageway 70 both upon a wall 25 that is perpendicular to the nozzle bore 80 and upon a wall 35 that is parallel to the nozzle bore 80.

Referring back to FIG. 13 and FIG. 12 respectively, detailed is a side view of the liquid drop ejector 10 of the present invention. FIG. 13 details pillars 90 are suspended in the liquid supply passageway 70 in a plane that is perpendicular to the nozzle bore 80 of liquid chamber 20. FIG. 12 details that pillars 90 are suspended in the liquid supply passageway 70 in a plane that is parallel to the nozzle bore 80 of liquid chamber 20

Figure 16:
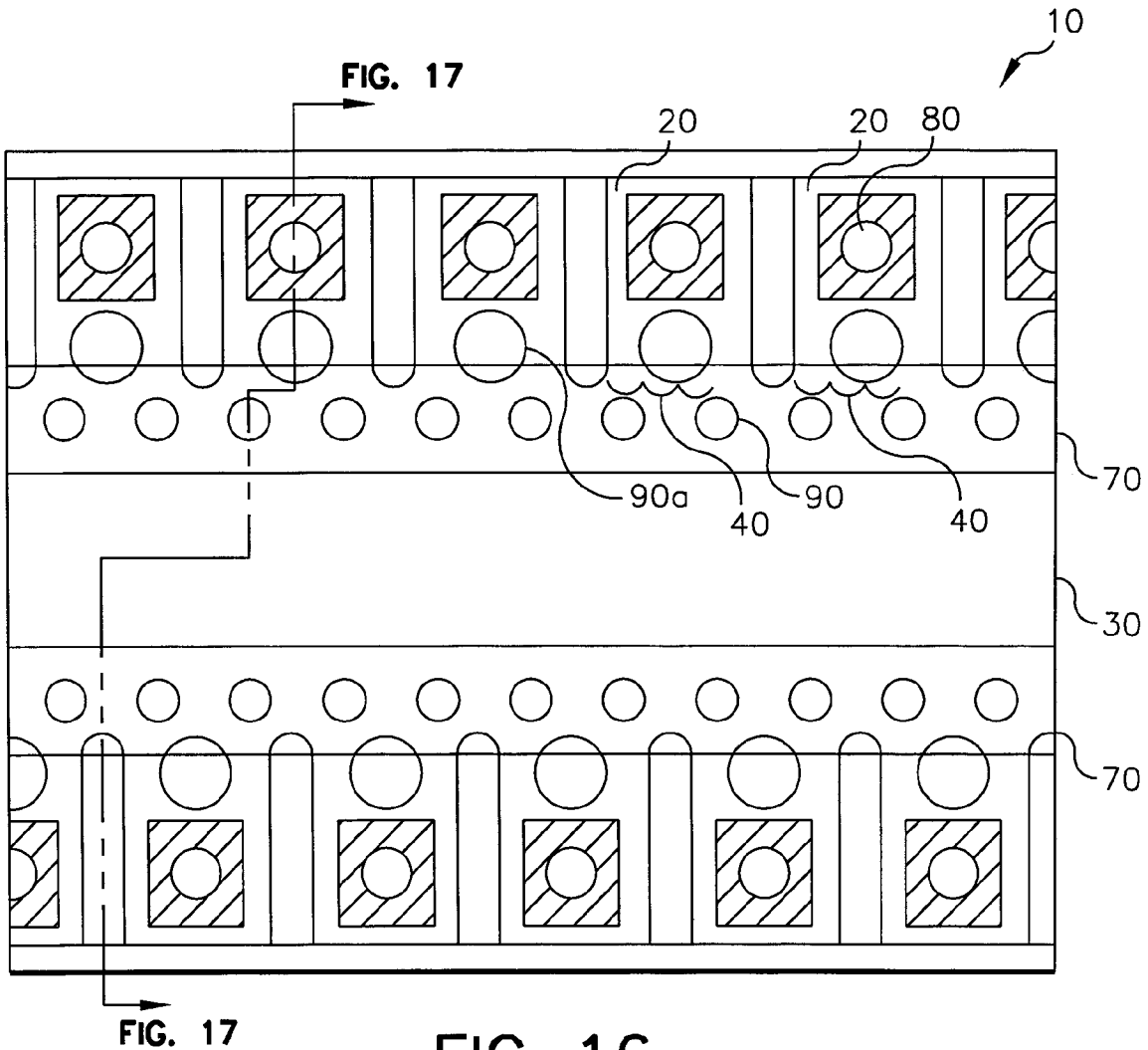
FIG. 16 is a partial planar view of the internal structure of the liquid drop ejector of the present invention, showing the suspended pillars along with a center pillar associated with the liquid drop ejector.

Referring to FIG. 16, detailed is a greatly magnified partial planar view of a liquid drop ejector 10 of the present invention. A liquid chamber 20 exists to forcibly eject a liquid 40 from liquid chamber 20 through nozzle bore 80 for a wide variety of purposes such as image reproduction. Note that by virtue of block 30 there exists a pair of well-defined liquid supply passageways 70. These liquid supply passageways 70 run along the entire length of the liquid drop ejector 10. Liquid 40 is supplied via a liquid supply passageway 70, and flows past pillars 90 that are used to trap particles that could plug liquid chamber 20 and/or nozzle bore 80 thus rendering a portion of the liquid drop ejector useless. It is commonplace for practitioners of the art to use pillars 90 for the purpose of filtering and support. The placement of pillars 90 within the liquid supply passageway 70 produces significantly enhanced refill, while still preserving effective filtering. This suspension of pillars 90 directly within the liquid supply passageway 70 allows for a shorter distance that the liquid 40 is required to flow to refill the liquid chamber 20. Thus, the refilling time of the liquid chamber 20 of the liquid drop ejector 10 is substantially improved. Referring also to FIG. 16, there exists a center pillar 90*a* wherein a first portion of the center pillar 90*a* is positioned within the liquid chamber 20 and wherein a second portion of the center pillar 90*a* is positioned within the liquid supply passageway 70.

Figure 17:
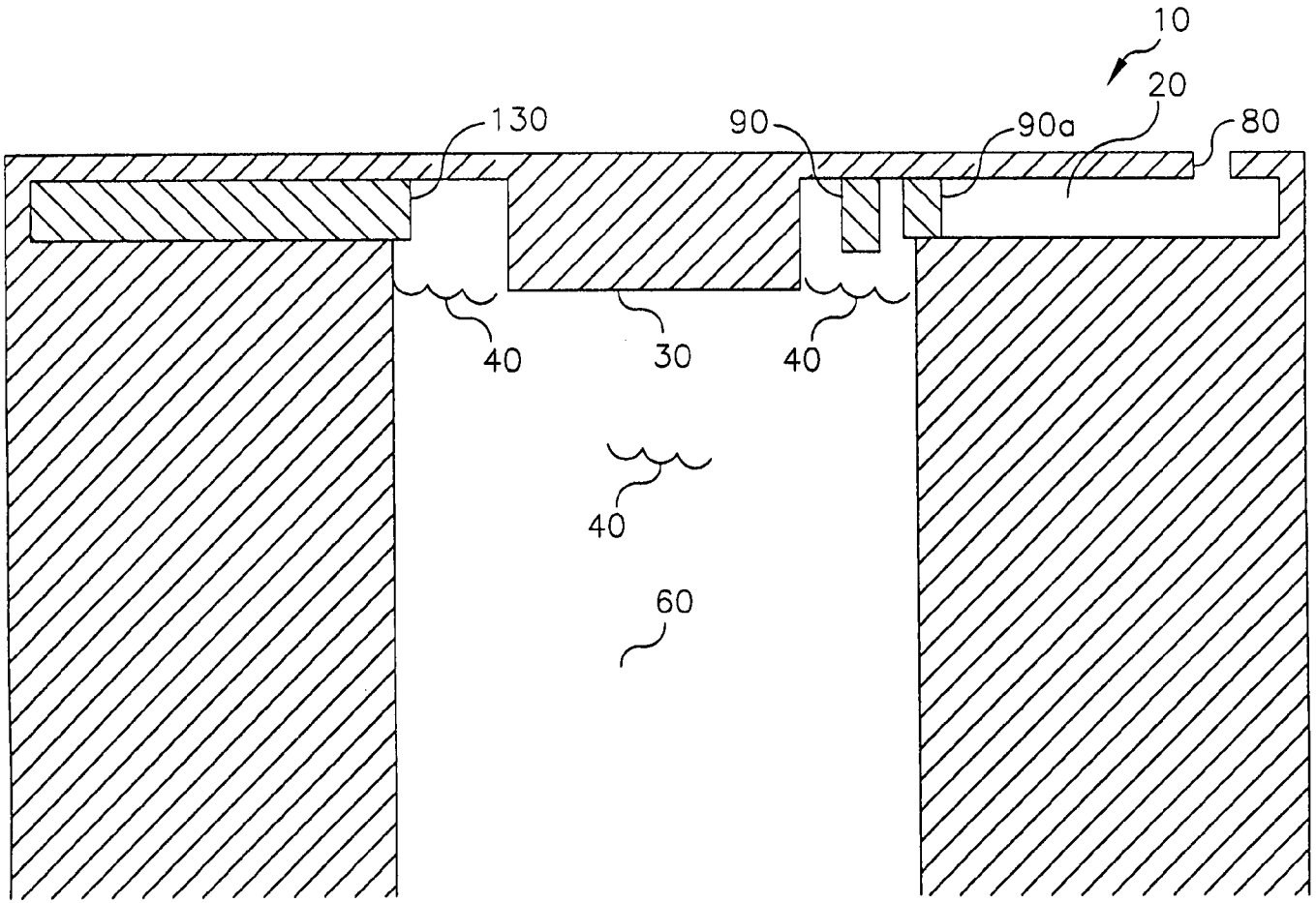
FIG. 17 is an alternate cross-sectional side view of the internal structure of the liquid drop ejector detailed in FIG. 16.

FIG. 17 details a cross-sectional view of a liquid drop ejector 10 previously detailed in FIG. 16, and shows the suspension of the pillars 90 directly within the liquid supply passageway 70. Note again that the suspension of the pillars 90 within the liquid supply passageway 70 allows a shorter liquid chamber 20. Referring also to FIG. 16, there exists a center pillar 90*a* wherein a first portion of the center pillar 90*a* is positioned within the liquid chamber and wherein a second portion of the center pillar 90*a* is positioned within the liquid supply passageway 70.

Figure 18:
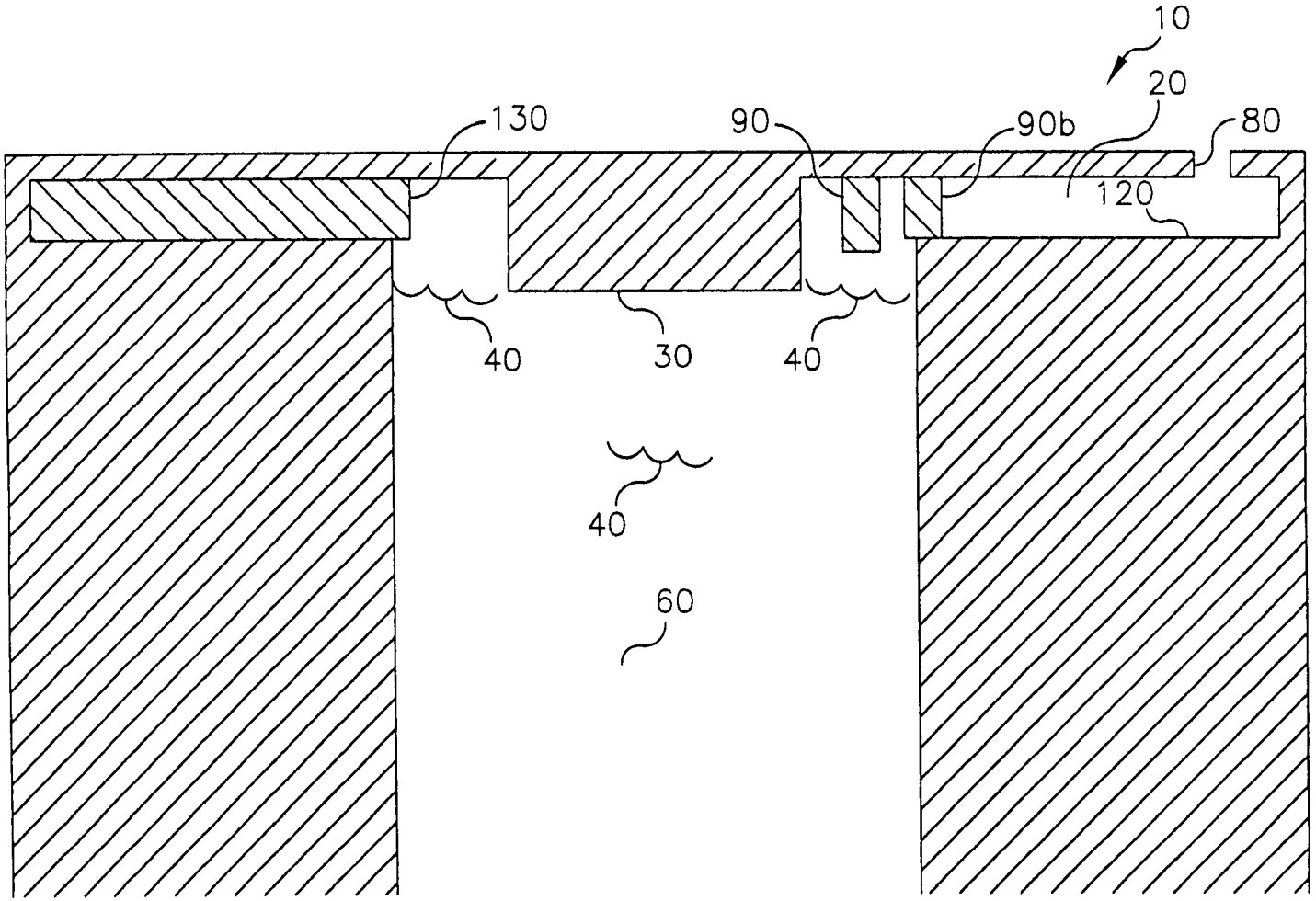
FIG. 18 is cross-sectional side view of a second internal configuration of the liquid drop ejector detailed in FIG. 17.

Referring to FIG. 18, detailed is a center pillar 90*b* positioned within the liquid supply passageway 70 of the liquid drop ejector 10. Pillar 90*b* has a top and a bottom (two ends). The top end of the pillar 90*b* is attached to a first wall (or roof 110) of the liquid supply passageway 70, and the bottom end is attached to a second wall (or floor 120) of the liquid supply passageway 70. A first portion of the second end (bottom) of pillar 90*b* is positioned within the liquid chamber 20, and a second portion of the second end (bottom) of pillar 90*b* is positioned within the liquid supply passageway 70.

Figure 19:
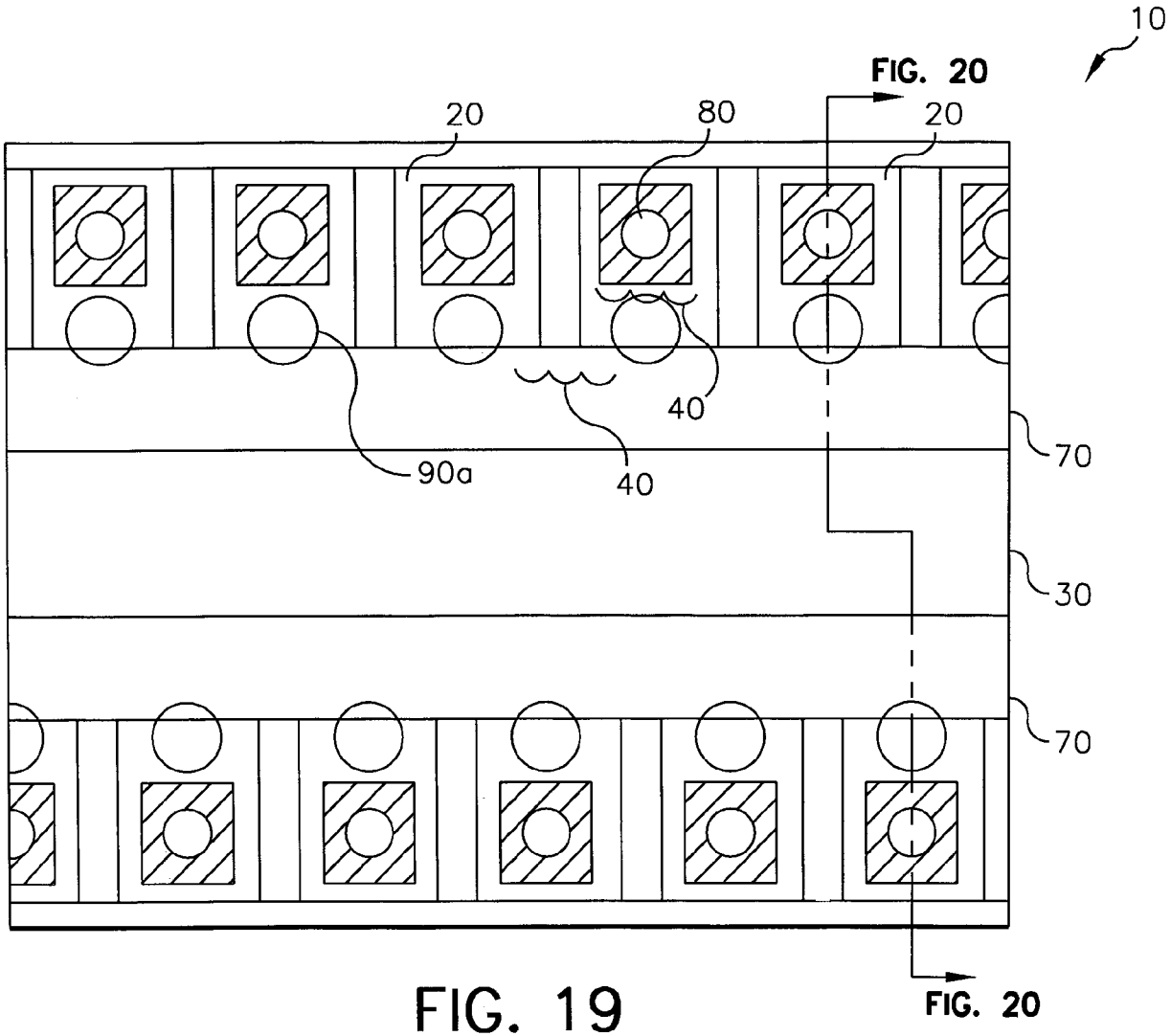
FIG. 19 is a partial planar view of the internal structure of the liquid drop ejector of the present invention.

Referring to FIG. 19, detailed is a greatly magnified partial planar view of a liquid drop ejector 10 of the present invention. A liquid chamber 20 exists to forcibly eject a liquid 40 from liquid chamber 20 through nozzle bore 80 for a wide variety of purposes such as image reproduction. Note that by virtue of block 30 there exists a pair of well-defined liquid supply passageways 70. These liquid supply passageways 70 run along the entire length of the liquid drop ejector 10. Liquid 40 is supplied via a liquid supply passageway 70, and flows past center pillars 90*a* that are used to trap particles that could plug liquid chamber 20 and/or nozzle bore 80 thus rendering a portion of the liquid drop ejector useless. Referring also to FIG. 19, note that center pillars 90*a* have a first portion positioned within the liquid chamber 20 and a second portion positioned within the liquid supply passageway 70.

Figure 20:
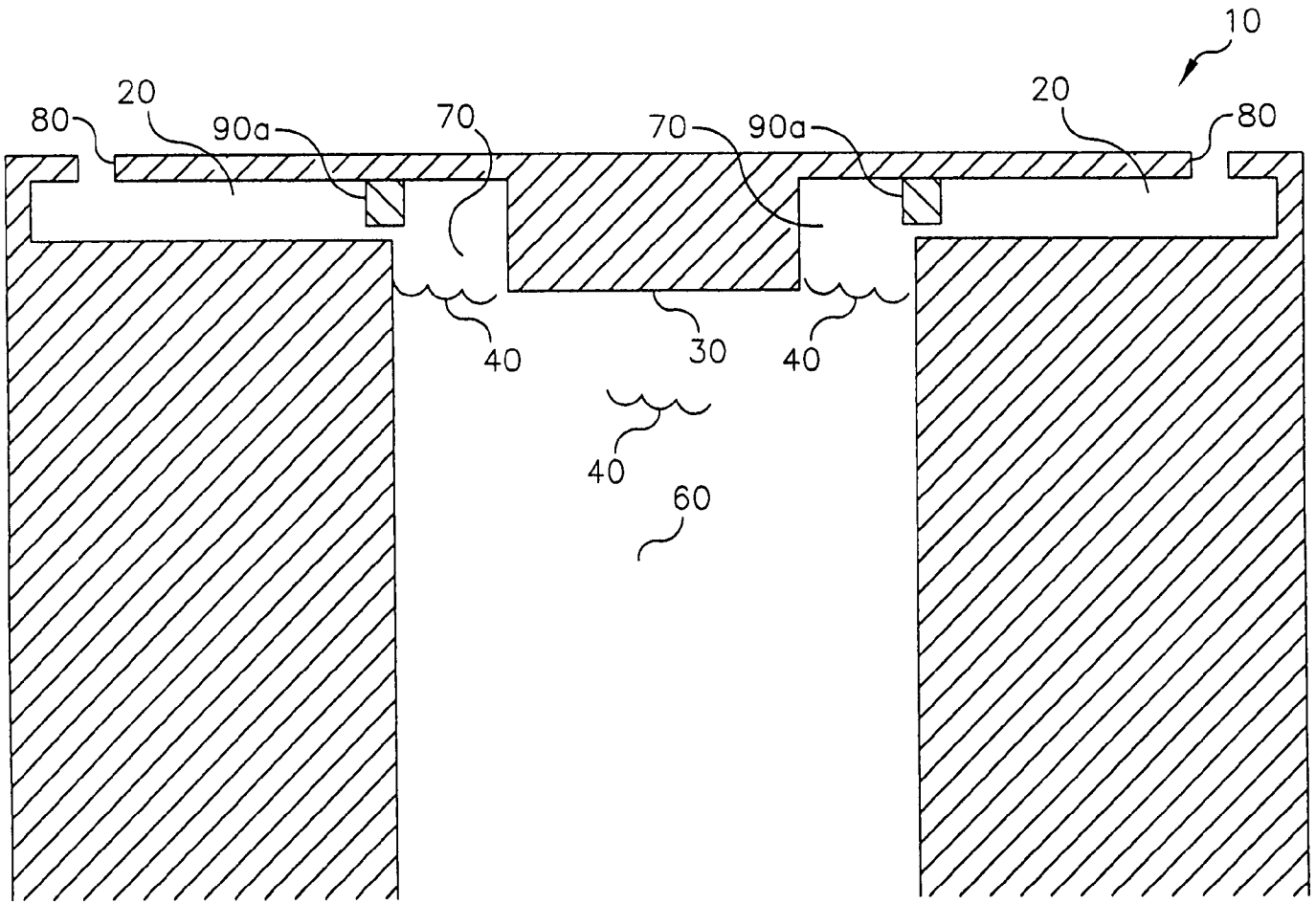
FIG. 20 is a cross-sectioned side view of the internal structure of the liquid drop ejector detailed in FIG. 19.

FIG. 20 details a cross-sectional view of a liquid drop ejector 10 previously detailed in FIG. 19, and shows the suspension of the pillars 90*a* partially within the liquid supply passageway 70. Note again, that the pillars 90*a* have a first portion positioned within the liquid chamber 20 and a second portion positioned within the liquid supply passageway 70.

Figure 21:
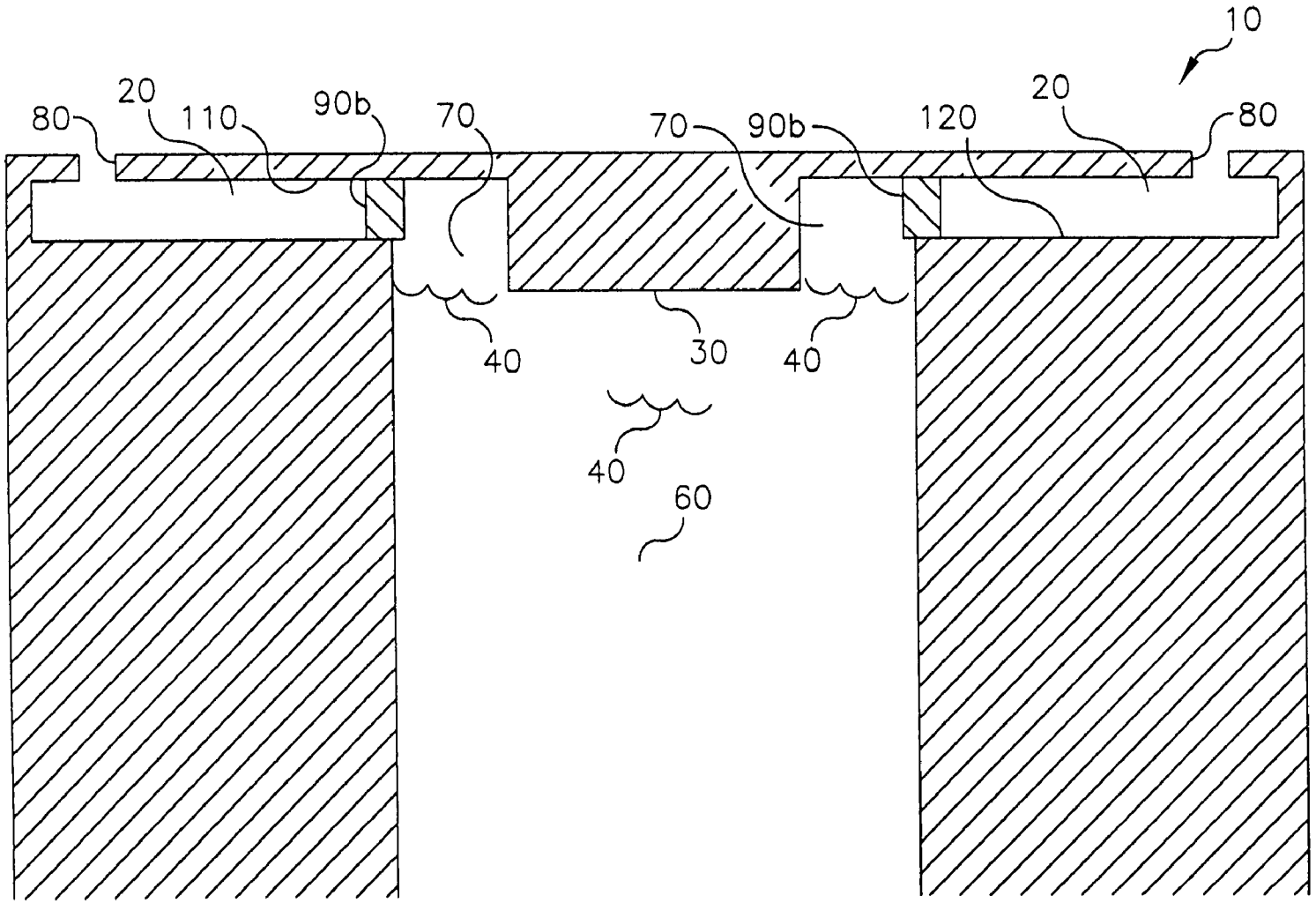
FIG. 21 is a second cross-sectioned side view of an alternate structure of the liquid drop ejector detailed in FIG. 20.

Referring now to FIG. 21, detailed are pillars 90*b* positioned with a first portion positioned within the liquid chamber 20 and a second portion positioned within the liquid supply passageway 70 of the liquid drop ejector 10. Pillars 90*b* have a top and a bottom (two ends). The top end of the pillars 90*b* is attached to a first wall (or roof 110) of the liquid supply passageway 70, and the bottom end is attached to a second wall (or floor 120) of the liquid supply passageway 70. A first portion of the second end (bottom) of pillars 90*b* is positioned within the liquid chamber 20, and a second portion of the second end (bottom) of pillars 90*b* is positioned within the liquid supply passageway 70.

Figure 22:
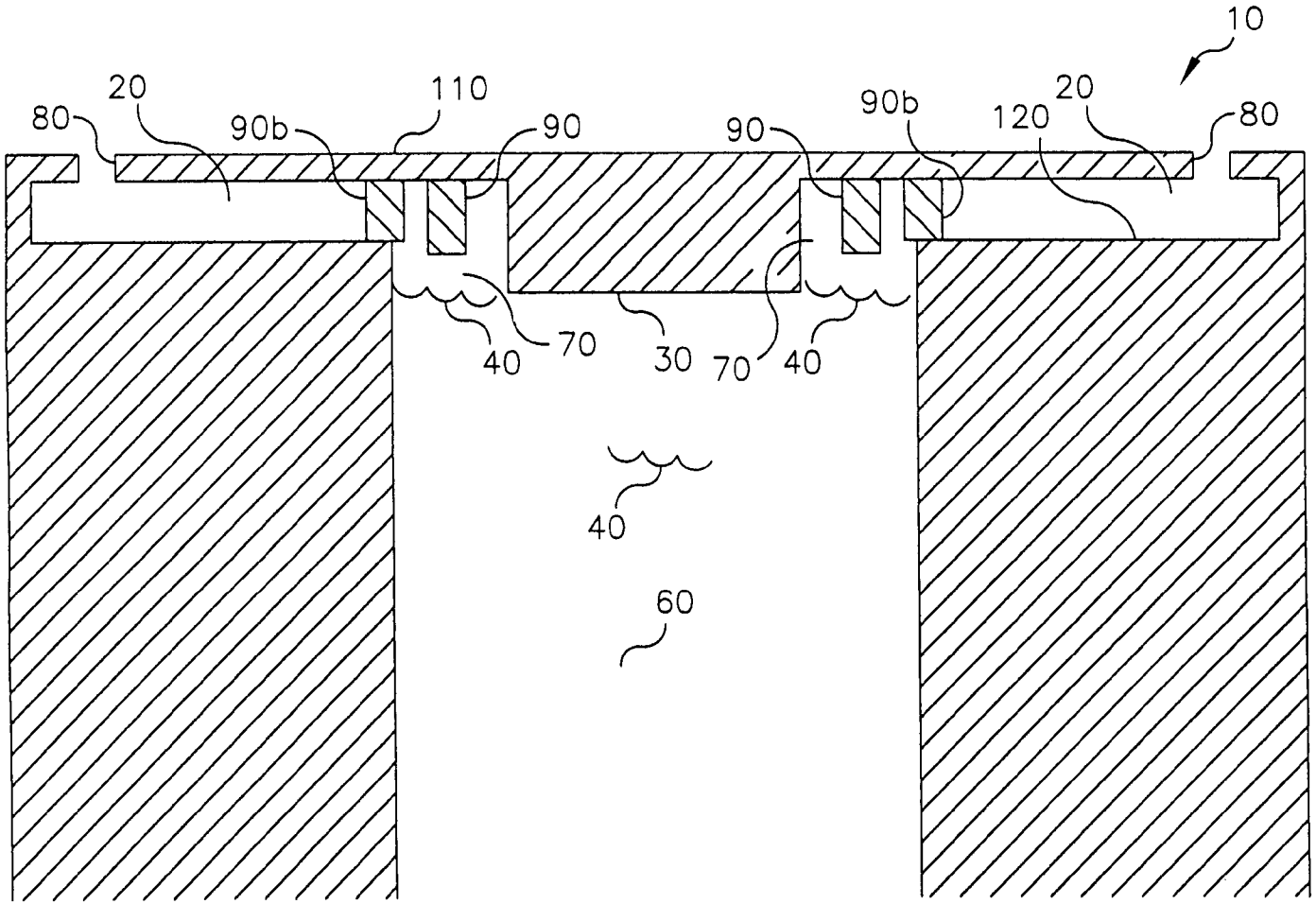
FIG. 22 is cross-sectional side view of another internal configuration of the liquid drop ejector detailed in FIG. 21 that adds pillars suspended from the wall of the liquid supply passageway.

Referring to FIG. 22, detailed is the addition of suspended pillars 90 that are positioned within the liquid supply passageway 70 of the liquid drop ejector 10. Note that one end of the pillars 90*b* is attached the wall (or roof 110) of the liquid supply passageway 70, and the second or bottom end is hanging freely into the liquid supply passageway 70. The placement of pillars 90 within the liquid supply passageway 70 produces significantly enhanced refill, while still preserving effective filtering.

Figure 23:
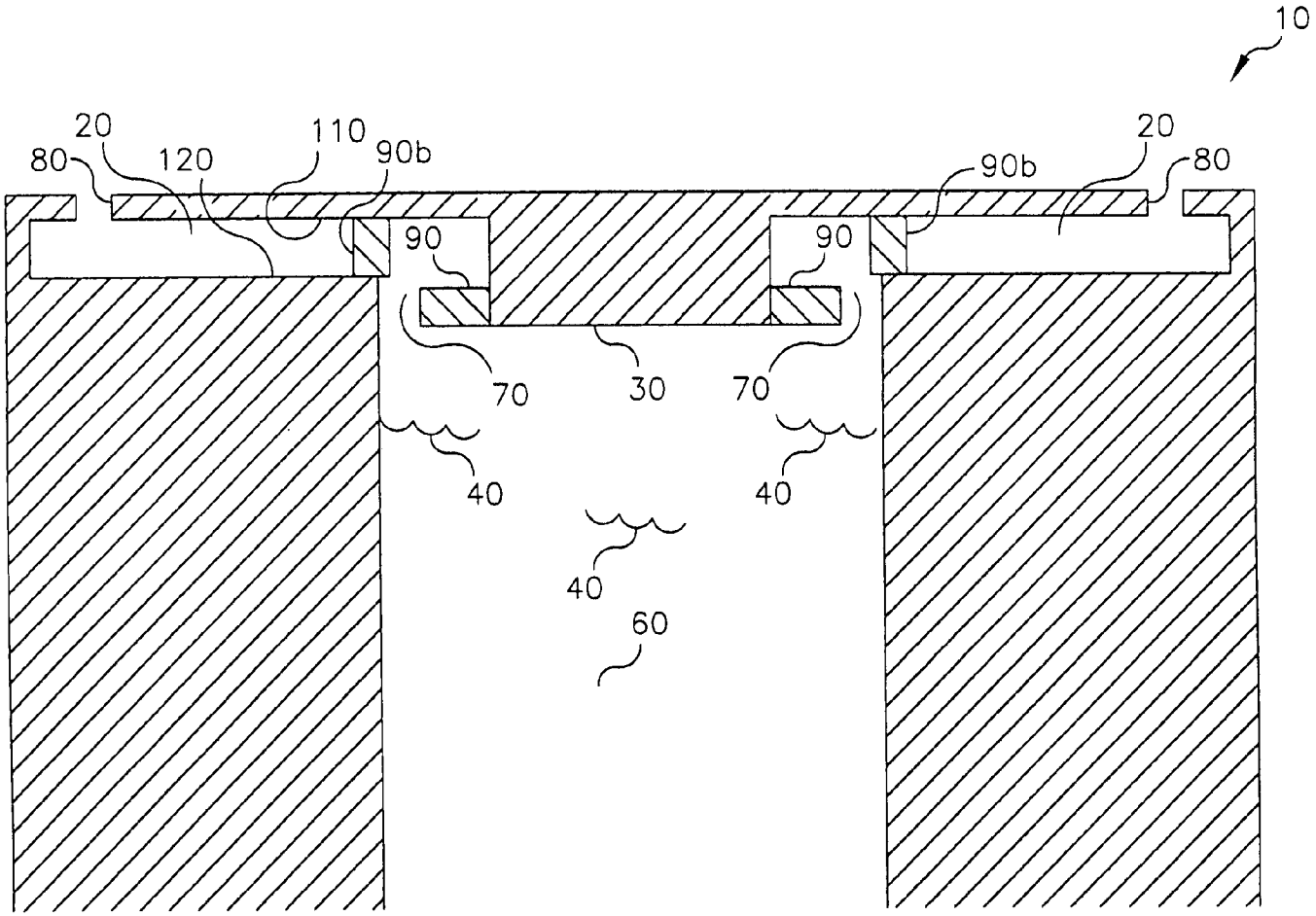
FIG. 23 is cross-sectional side view of another internal configuration of the liquid drop ejector detailed in FIG. 22 that adds pillars attached to a first wall.

Referring to FIG. 23, detailed is the addition of alternate pillars 90 that are positioned within the liquid supply passageway 70 of the liquid drop ejector 10. One end of the pillar 90*b* is attached to a first vertical wall of the liquid supply passageway 70, and the second or bottom end is hanging freely into the liquid supply passageway 70. The placement of pillars 90 within the liquid supply passageway 70 produces significantly enhanced refill, while still preserving effective filtering.

Figure 24:
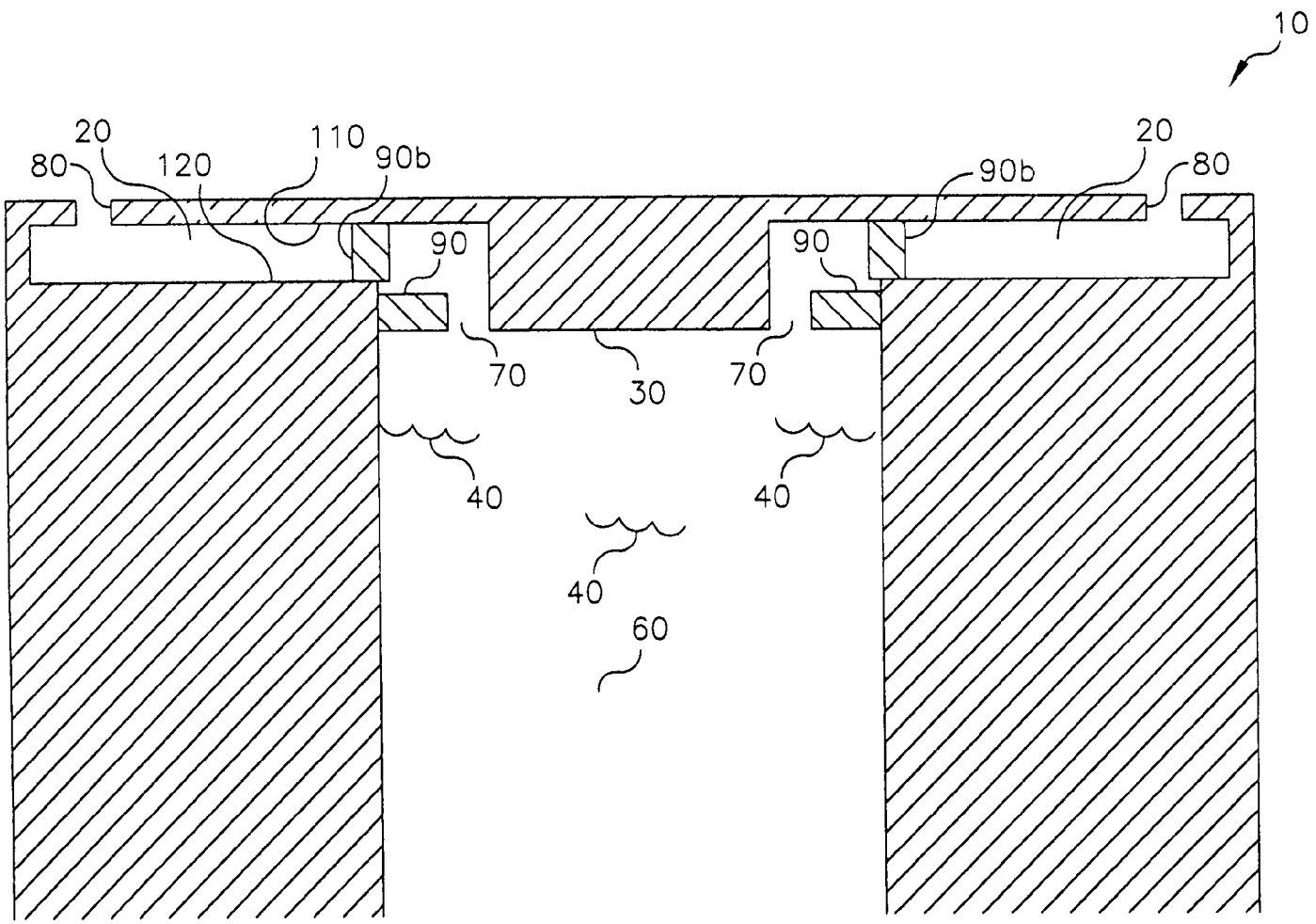
FIG. 24 is cross-sectional side view of another internal configuration of the liquid drop ejector detailed in FIG. 22 that adds pillars attached to a second wall.

Referring to FIG. 24, detailed is the addition of yet another alternate pillars 90 that are positioned within the liquid supply passageway 70 of the liquid drop ejector 10. One end of the pillar 90*b* is attached to a second vertical wall of the liquid supply passageway 70, and the second or bottom end is hanging freely into the liquid supply passageway 70. The placement of pillars 90 within the liquid supply passageway 70 produces significantly enhanced refill, while still preserving effective filtering.

It should be noted that FIG. 2 and FIG. 3 are both side views of the liquid drop ejector 10 of the present invention.

Referring to the area of the liquid supply passageway 70, there exists a plurality of walls. FIG. 2 details a wall perpendicular to the nozzle bore 25 upon which pillars 90 are attached. FIG. 3 details a wall parallel to the nozzle bore to which pillars 90 are attached.

Figure 25:
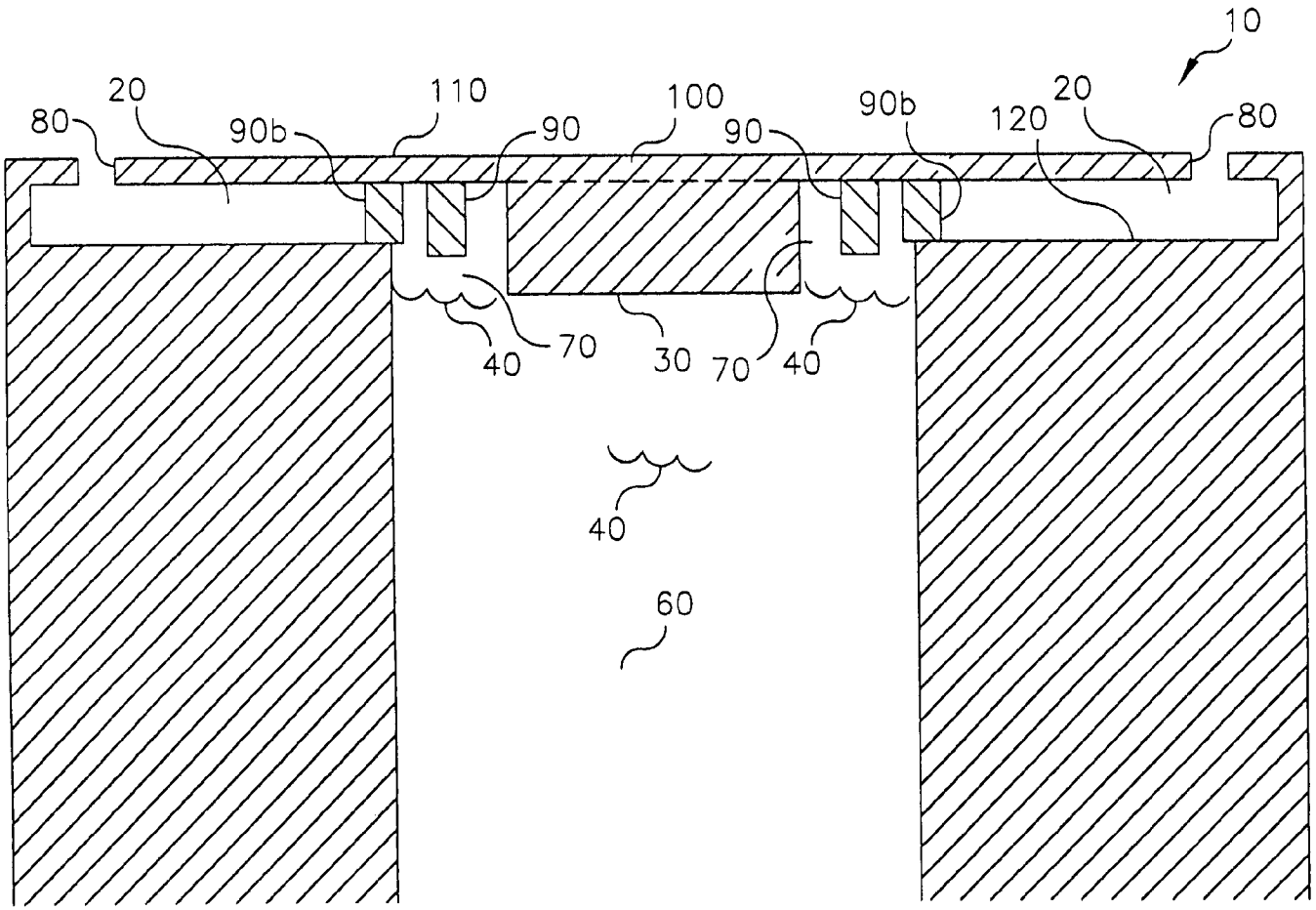
FIG. 25 is cross-sectional side view of another internal configuration of the liquid drop ejector wherein the drop ejector is comprised of a nozzle plate.

Referring now to FIG. 25 detailed is a side view of the liquid drop ejector 10 of the present invention. Referring to the area of the liquid supply passageway 70, there exists a plurality of walls. In this configuration a nozzle plate 100 covers the liquid chambers 20. FIG. 25 details a nozzle plate 100 that extends between the liquid chambers 20 and the liquid supply passageways 70, to which pillars 90 and center pillars 90*b* are attached.

Referring back to FIG. 23 and FIG. 22 respectively, detailed is a side view of the liquid drop ejector 10 of the present invention. FIG. 23 details pillars 90 are suspended in the liquid supply passageway 70 in a plane that is perpendicular to the nozzle bore 80 as viewed from a plane perpendicular to a cross sectional view of the nozzle bore 80. FIG. 22 details that pillars 90 are suspended in the liquid supply passageway 70 in a plane that is parallel to the nozzle bore 80 as viewed from a plane perpendicular to a cross sectional view of the nozzle bore 80.

Figure 26:
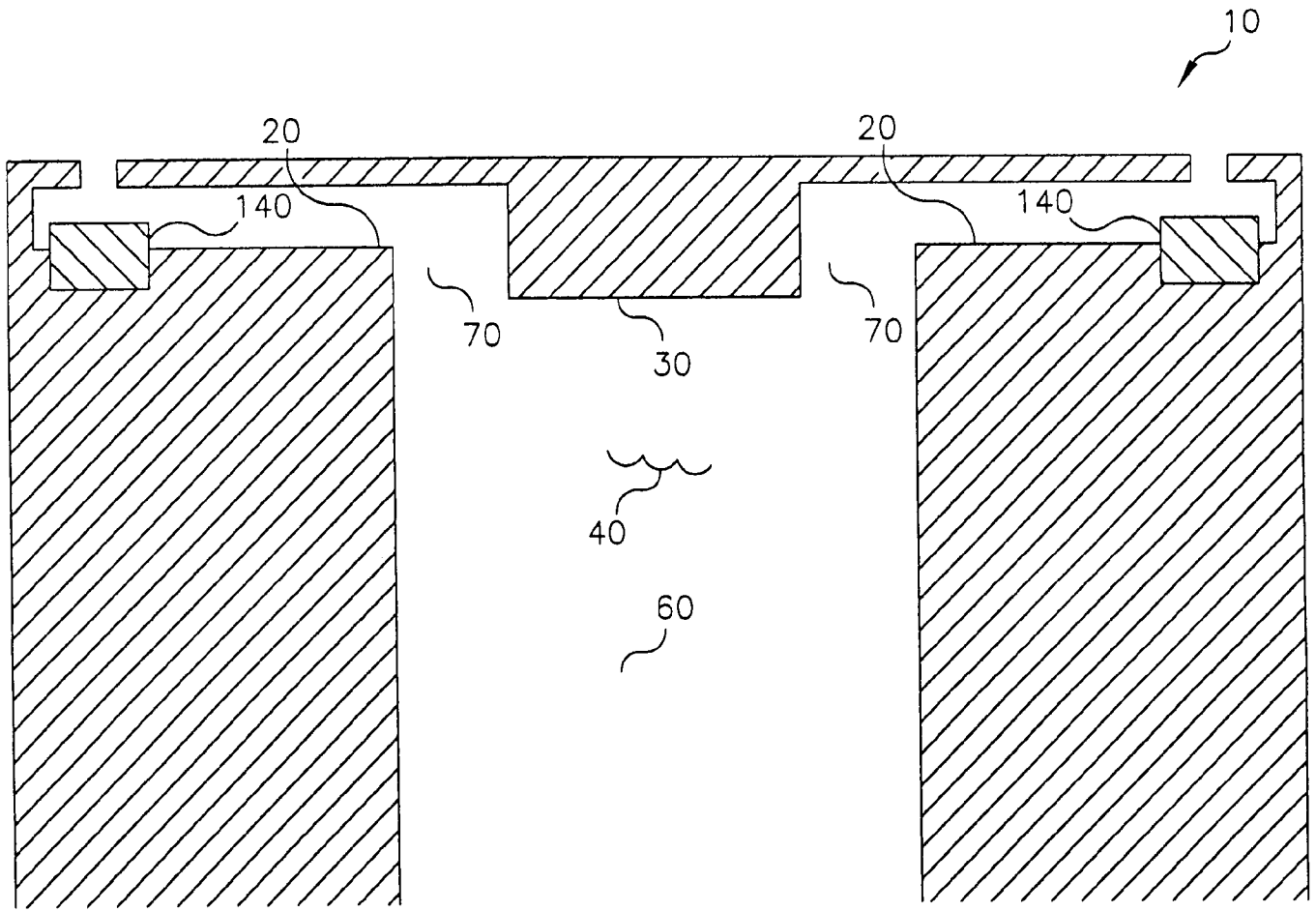
FIG. 26 is a cross-sectional view of the liquid drop ejector of the present invention detailing a view where there is a drop forming mechanism associated with the liquid chamber.

Referring next to FIG. 26, detailed is a side view of the liquid drop ejector 10 of the present invention, wherein the liquid chambers 20 exist to forcibly eject a liquid 40 from liquid chamber 20 through nozzle bore 80 for a wide variety of purposes such as image reproduction. Note that by virtue of block 30 there exists a pair of well-defined liquid supply passageways 70. These liquid supply passageways 70 run along the entire length of the liquid drop ejector 10. This defines liquid supply passageways 70, one existing on each side of block 30, and where there is associated with the liquid drop ejector 10. A drop forming mechanism 140 exists within the liquid chamber 20.

Figure 27:
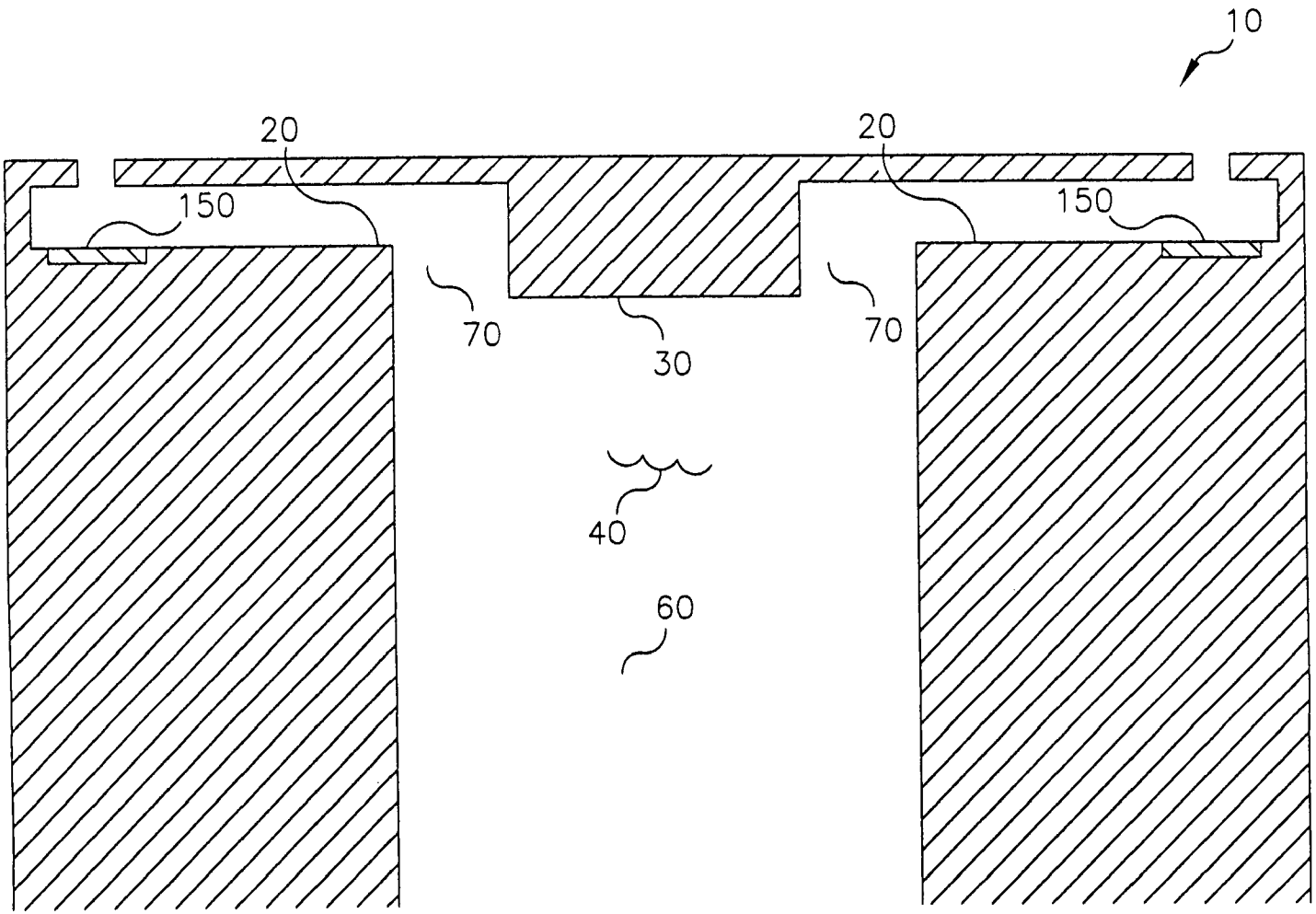
FIG. 27 is a cross-sectional view of the liquid drop ejector of the present invention detailing a view where there is a heater below the nozzle bore.
Figure 28:
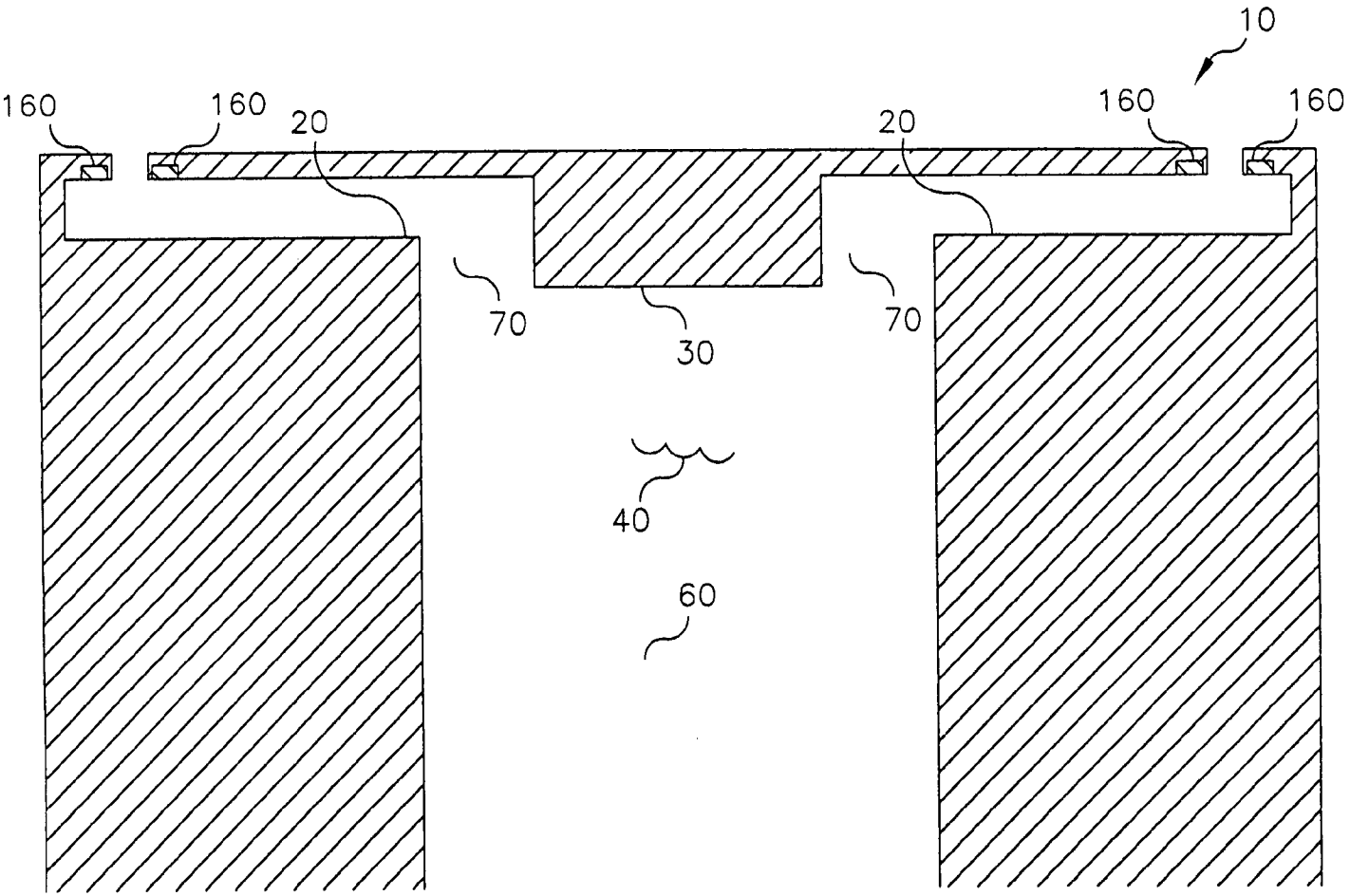
FIG. 28 is a cross-sectional view of the liquid drop ejector of the present invention detailing a view where there is a heater adjacent the nozzle bore.

Referring now to FIG. 27 and FIG. 28 detailed is a side view of the liquid drop ejector 10 of the present invention. Liquid chambers 20 exist to forcibly eject a liquid 40 from liquid chamber 20 through nozzle bore 80 for a wide variety of purposes such as image reproduction. Note that by virtue of block 30 there exists a pair of well-defined liquid supply passageways 70. These liquid supply passageways 70 run along the entire length of the liquid drop ejector 10. FIG. 27 details an embodiment wherein there exists a heater below 150 the nozzle bore 80 of the liquid chamber 20. FIG. 28 details an embodiment wherein there exists a heater adjacent 160 the nozzle bore 80 positioned within the liquid chamber 20.

Figure 29:
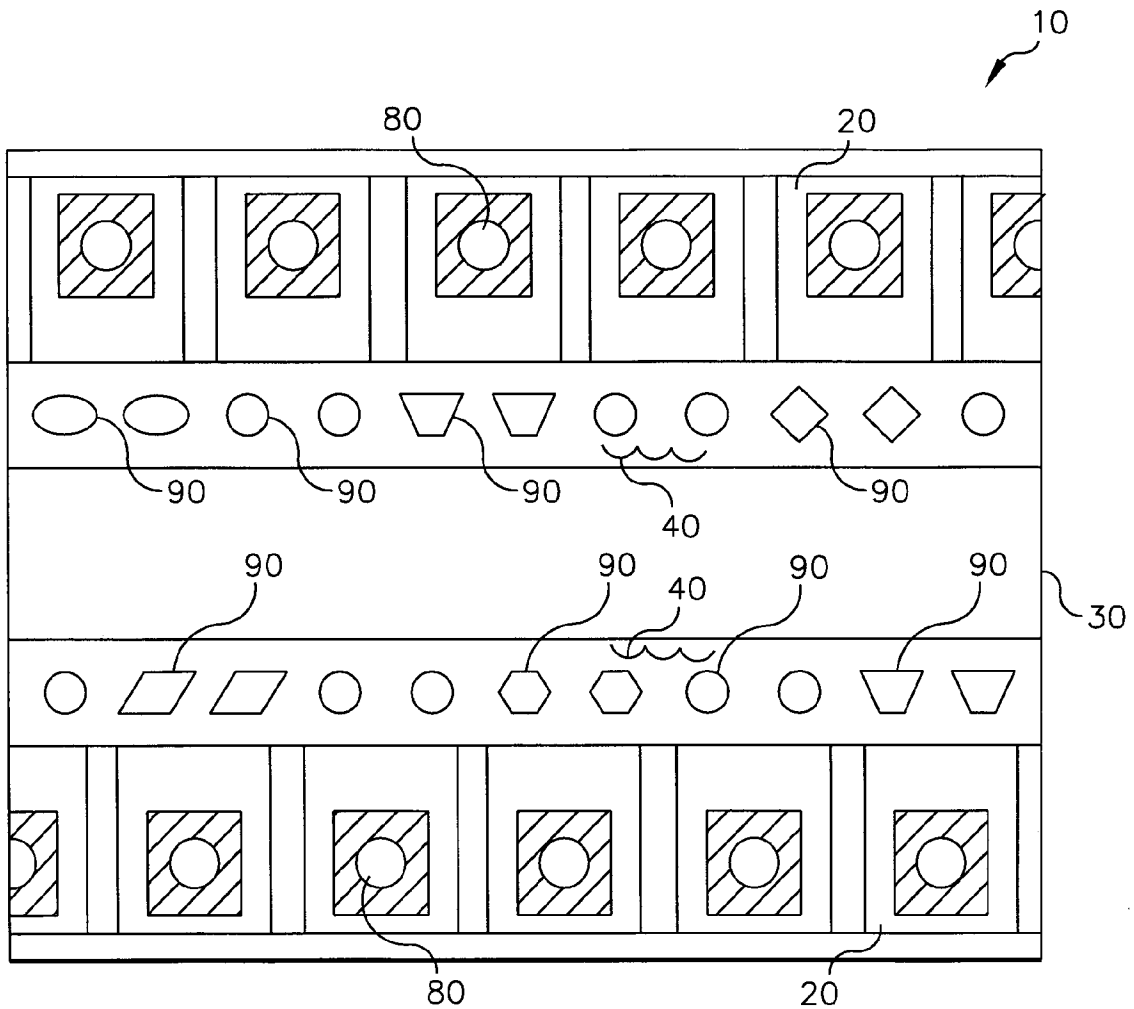
FIG. 29 is a partial planar view of an internal structure of the liquid drop ejector of the present invention.

Referring lastly to FIG. 29, detailed is a side view of the liquid drop ejector 10 of the present invention. Liquid chambers 20 exist to forcibly eject a liquid 40 from liquid chamber 20 through nozzle bore 80 for a wide variety of purposes such as image reproduction. Note that by virtue of block 30 there exists a pair of well-defined liquid supply passageways 70. These liquid supply passageways 70 run along the entire length of the liquid drop ejector 10. It should be understood that the pillars 90 that exist within the liquid drop ejector 10 could embody a variety of shapes and configurations including shapes that are circular and shapes that the perimeter of its cross section forms a variety of closed curves.

The invention has been described in detail with particular reference to certain preferred embodiments thereof, but it will be understood that variations and modifications can be effected within the scope of the invention.

PARTS LIST

10 liquid drop ejector
20 liquid chamber
21 center block
25 wall perpendicular to nozzle bore
30 block
35 wall parallel to nozzle bore
40 liquid
50 common area
60 liquid supply area
70 liquid supply passageway
80 nozzle bore
90 pillar
100 nozzle plate
110 roof
120 floor
130 chamber wall
140 drop forming mechanism
150 heater below
160 heater adjacent

What is claimed is:

1. A liquid drop ejector comprising:

a liquid chamber having a roof, portions of the liquid chamber defining a nozzle bore;

a liquid supply area beneath the roof and including a block suspended from the roof into the liquid supply area such that a liquid supply passageway is defined at opposite sides of the block to extend between the liquid chamber and the liquid supply area, the liquid supply passageway being in fluid communication with the liquid chamber and the liquid supply area and including a wall; and a plurality of pillars suspended in the liquid supply passageway such that at least one of the plurality of pillars has one end attached to the wall of the liquid supply passageway and another end at least partially freely overhanging the liquid supply area.

2. The liquid drop ejector according to claim 1, wherein the wall of the liquid supply passageway is substantially perpendicular to the nozzle bore as viewed from a plane perpendicular to a cross sectional view of the nozzle bore.

3. The liquid drop ejector according to claim 1, wherein the wall of the liquid supply passageway is parallel to the nozzle bore as viewed from a plane perpendicular to a cross sectional view of the nozzle bore.

4. The liquid drop ejector according to claim 1, the portions of the liquid chamber defining the nozzle bore including a nozzle plate extending between the liquid chamber and the liquid supply passageway, wherein the wall of the liquid supply passageway includes a portion of the nozzle plate, the plurality of pillars being suspended from the nozzle plate portion.

5. The liquid drop ejector according to claim 1, wherein the pillars are suspended in the liquid supply passageway in a plane perpendicular to the nozzle bore as viewed from a plane perpendicular to a cross sectional view of the nozzle bore.

6. The liquid drop ejector according to claim 1, wherein the pillars are suspended in the liquid supply passageway in a plane parallel to the nozzle bore as viewed from a plane perpendicular to a cross sectional view of the nozzle bore.

7. The liquid drop ejector according to claim 1, further comprising:

a center pillar, a portion of the center pillar being positioned in the liquid chamber and another portion of the center pillar being positioned in the liquid supply passageway.

8. The liquid drop ejector according to claim 7, the center pillar having two ends, one end being attached to a wall common to the liquid chamber and the liquid supply passageway, a portion of the second end being attached to another wall common to the liquid supply passageway and the liquid chamber and another portion of the second end being suspended in the liquid supply passageway.

9. The liquid drop ejector according to claim 1, further comprising:

a drop forming mechanism operatively associated with the liquid chamber.

10. The liquid drop ejector according to claim 9, wherein the drop forming mechanism comprises a heater.

11. The liquid drop ejector according to claim 10, wherein the heater is positioned adjacent to the nozzle bore.

12. The liquid drop ejector according to claim 10, wherein the heater is positioned in the liquid chamber.

13. The liquid drop ejector according to claim 1, the pillars having a cross sectional shape, wherein a portion of the cross sectional shape is circular.

14. The liquid drop ejector according to claim 1, the pillars having a cross sectional shape having a perimeter, wherein the perimeter of the cross sectional shape forms a closed curve.

15. The liquid drop ejector according to claim 1, further comprising:

additional liquid chambers, portions of each additional liquid chamber defining a nozzle bore, wherein each additional liquid chamber is in fluid communication with the liquid supply passageway.

16. A liquid drop ejector comprising:

a plurality of liquid chambers having a roof, portions of each of the plurality of liquid chambers defining a nozzle bore, other portions of each of the plurality of liquid chambers defining a wall located between adjacent liquid chambers, the wall having a length;

a liquid supply area beneath the roof and including a block suspended from the roof into the liquid supply area such that a liquid supply passageway is defined at opposite sides of the block to extend between each of the plurality of liquid chambers and the liquid supply area, the liquid supply passageway being in fluid communication with each of the plurality of liquid chambers and the liquid supply area, the length of the wall extending into the liquid supply passageway such that a portion of the length of the wall freely overhangs the liquid supply area; and a plurality of pillars suspended in the liquid supply passageway.

17. The liquid drop ejector according to claim 16, the liquid supply passageway having a wall, wherein the pillars are suspended from the wall of the liquid supply passageway.

18. The liquid drop ejector according to claim 17, wherein the wall of the liquid supply passageway is substantially perpendicular to the nozzle bore as viewed from a plane perpendicular to a cross sectional view of the nozzle bore.

19. The liquid drop ejector according to claim 17, wherein the wall of the liquid supply passageway is parallel to the nozzle bore as viewed from a plane perpendicular to a cross sectional view of the nozzle bore.

20. The liquid drop ejector according to claim 16, wherein the portions of the liquid chamber defining the nozzle bore include a nozzle plate extending between the liquid chamber and the liquid supply passageway, the pillars being suspended from the nozzle plate.

21. The liquid drop ejector according to claim 16, wherein the pillars are suspended in the liquid supply passageway in a plane perpendicular to the nozzle bore as viewed from a plane perpendicular to a cross sectional view of the nozzle bore.

22. The liquid drop ejector according to claim 16, wherein the pillars are suspended in the liquid supply passageway in a plane parallel to the nozzle bore as viewed from a plane perpendicular to a cross sectional view of the nozzle bore.

23. The liquid drop ejector according to claim 16, wherein the plurality of pillars is associated with one of the plurality of liquid chambers.

24. The liquid drop ejector according to claim 16, wherein one pillar of the plurality of pillars is associated with one chamber of the plurality of liquid chambers.

25. A liquid drop ejector comprising:

a plurality of liquid chambers having a roof, portions of each of the plurality of liquid chambers defining a nozzle bore, other portions of each of the plurality of liquid chambers defining a wall located between adjacent liquid chambers, the wall having a length;

a liquid supply area beneath the roof and including a block suspended from the roof into the liquid supply area such that a liquid supply passageway is defined at opposite sides of the block to extend between each of the plurality of liquid chambers and the liquid supply area, the liquid supply passageway being in fluid communication with each of the plurality of liquid chambers and the liquid supply area, the length of the wall extending into the liquid supply passageway such that a portion of the length of the wall freely overhangs the liquid supply area; and a center pillar, a portion of the center pillar being positioned in the liquid chamber and another portion of the center pillar being positioned in the liquid supply passageway.

26. The liquid drop ejector according to claim 25, the center pillar having two ends, one end being attached to a wall common to the liquid chamber and the liquid supply passageway, a portion of the second end being attached to another wall common to the liquid supply passageway and the liquid chamber and another portion of the second end being suspended in the liquid supply passageway.

27. A liquid drop ejector comprising:

a liquid chamber having a roof, portions of the liquid chamber defining a nozzle bore;

a liquid supply area beneath the roof and including a block suspended from the roof into the liquid supply area such that a liquid supply passageway is defined at opposite sides of the block to extend between the liquid chamber and the liquid supply area, the liquid supply passageway being in fluid communication with the liquid chamber and the liquid supply area; and a center pillar, a portion of the center pillar being positioned in the liquid chamber and another portion of the center pillar being positioned in the liquid supply passageway such that one end of the center pillar partially freely overhangs the liquid supply area.

28. The liquid drop ejector according to claim 27, the center pillar having two ends, one end being attached to a wall common to the liquid chamber and the liquid supply passageway, a portion of the second end being attached to another wall common to the liquid supply passageway and the liquid chamber and another portion of the second end being suspended in the liquid supply passageway.

29. The liquid drop ejector according to claim 27, further comprising:

a plurality of pillars suspended in the liquid supply passageway.

30. The liquid drop ejector according to claim 29, the liquid supply passageway having a wall, wherein the pillars are suspended from the wall of the liquid supply passageway.

31. The liquid drop ejector according to claim 30, wherein the wall of the liquid supply passageway is substantially perpendicular to the nozzle bore as viewed from a plane perpendicular to a cross sectional view of the nozzle bore.

32. The liquid drop ejector according to claim 30, wherein the wall of the liquid supply passageway is parallel to the nozzle bore as viewed from a plane perpendicular to a cross sectional view of the nozzle bore.

33. The liquid drop ejector according to claim 29, wherein the portions of the liquid chamber defining the nozzle bore include a nozzle plate extending between the liquid chamber and the liquid supply passageway, the pillars being suspended from the nozzle plate.

34. The liquid drop ejector according to claim 29, wherein the pillars are suspended in the liquid supply passageway in a plane perpendicular to the nozzle bore as viewed from a plane perpendicular to a cross sectional view of the nozzle bore.

35. The liquid drop ejector according to claim 29, wherein the pillars are suspended in the liquid supply passageway in a plane parallel to the nozzle bore as viewed from a plane perpendicular to a cross sectional view of the nozzle bore.

* * * * *